US009506124B2

(12) United States Patent
Poloni et al.

(10) Patent No.: US 9,506,124 B2
(45) **Date of Patent: *Nov. 29, 2016**

(54) TILTING OXYGEN CONVERTER

(75) Inventors: Alfredo Poloni, Fogliano Redipuglia (IT); Matteo Nobile, Ruda (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 224 days.

This patent is subject to a terminal disclaimer.

(21) Appl. No.: 14/130,853

(22) PCT Filed: Jul. 6, 2012

(86) PCT No.: PCT/IB2012/053463

§ 371 (c)(1),
(2), (4) Date: Jan. 3, 2014

(87) PCT Pub. No.: WO2013/008158

PCT Pub. Date: Jan. 17, 2013

(65) Prior Publication Data

US 2014/0159288 A1 Jun. 12, 2014

(30) Foreign Application Priority Data

Jul. 8, 2011 (IT) ..... MI2011A1277

(51) Int. Cl.

| | |
|---|---|
| ***C21C 5/50*** | (2006.01) |
| ***C21C 5/46*** | (2006.01) |
| ***F27B 3/06*** | (2006.01) |
| ***F27B 7/22*** | (2006.01) |

(52) U.S. Cl.

CPC ..... *C21C 5/50* (2013.01); *C21C 5/4633* (2013.01); *F27B 3/065* (2013.01); *F27B 7/22* (2013.01)

(58) Field of Classification Search

CPC ..... C21C 5/50; C21C 5/4633
USPC ..... 266/246
See application file for complete search history.

(56) References Cited

U.S. PATENT DOCUMENTS

| | | |
|---|---|---|
| 3,497,197 A | 2/1970 | Puhringer |
| 3,561,709 A | 2/1971 | Bornscheuer |

(Continued)

FOREIGN PATENT DOCUMENTS

| | | |
|---|---|---|
| GB | 1290931 | 9/1972 |
| GB | 2344872 | 6/2000 |
| WO | WO9853261 | 11/1998 |

OTHER PUBLICATIONS

Zebo Zhao, Qin Qin, Diping Wu and Yong Zang, "Structure Optimization for Link Suspension System of a 180t BOF Vessel", Computer-Aided Industrial Design & Conceptual Design, 2009, pp. 803-807.

*Primary Examiner* — Scott Kastler
(74) *Attorney, Agent, or Firm* — Stetina Brunda Garred & Brucker

(57) ABSTRACT

A converter comprising a container (2) defining a first axis X; a support ring (3), coaxial to the container and spaced therefrom, provided with two diametrically opposed supporting pins (6), defining a second axis Y orthogonal to the first axis X, adapted to allow a rotation of the converter about the axis Y; suspension elements, connecting said container to said support ring, clamped at a first end to the container and at a second end to the support ring so as to not require any maintenance as compared to traditional systems which use spherical joints and pins which are subject to wear, thus saving hours of maintenance and plant standstill.

14 Claims, 18 Drawing Sheets

(56) References Cited

U.S. PATENT DOCUMENTS

| | | | | |
|---|---|---|---|---|
| 3,575,402 | A | 4/1971 | Mahringer et al. | |
| 4,096,918 | A | 6/1978 | Beggs et al. | |
| 5,364,079 | A | 11/1994 | Gruber et al. | |
| 2014/0159288 | A1* | 6/2014 | Poloni | C21C 5/4633 266/200 |
| 2014/0197584 | A1* | 7/2014 | Poloni | C21C 5/50 266/200 |
| 2015/0152514 | A1* | 6/2015 | Poloni | C21C 5/4633 266/246 |

* cited by examiner

TILTING OXYGEN CONVERTER

CROSS REFERENCE TO RELATED APPLICATIONS

The present application claims priority to PCT International Application No. PCT/IB2012/053463 filed on Jul. 6, 2012, which application claims priority to Italian Patent Application No. MI20111A001277 filed Jul. 8, 2011.

STATEMENT RE: FEDERALLY SPONSORED RESEARCH/DEVELOPMENT

Not Applicable.

BACKGROUND OF THE INVENTION

Field of the Invention

The present invention relates to a tilting oxygen converter provided with a suspension system for the converter container, said system connecting said container to a support ring.

State of the Art

The main object of an oxygen converter is to convert the cast iron produced in the blast furnace into raw liquid steel, which can be then refined in the secondary steel production department.

The principal functions of the oxygen converter, also known as a B.O.F. (Basic Oxygen Furnace), are to decarbonize and remove the phosphorus from the cast iron and optimize the temperature of the steel so that further treatments can be carried out before casting with minimum heating and cooling of the steel.

The exothermic oxidation reactions which are generated in the converter produce a lot of thermal energy, more than the energy needed for reaching the determined temperature of the steel. This extra heat is used to melt the scrap metal and/or the added ferrous mineral. As the B.O.F. substantially is a furnace, it is also subject to thermal dilatations.

As example of as oxygen converter, belonging to the state of the art, is described in the document U.S. Pat. No. 5,364,079.

Said converter consists of a container, defining the reactor and having a substantially cylindrical shape, supported by a support ring ("trunnion ring"), surrounding the container and suitably spaced therefrom, provided with two diametrically opposed supporting pins ("trunnions"), the assembly supported by two supports anchored to the ground. The container relation control is keyed onto one of the two supporting pins.

Said converter is supported by means of an external support ring and a suspension consisting of a plurality of articulated braces and related supports, arranged on the lower side of the support ring when the converter is in a vertical position. Each support, articulated by means of ball joints, is designed to be fixed to the support ring on one side and to the container on the other side.

Thereby, the converter is supported by a series of articulated supports which allow the container dilatations and self-alignment between the external support ring and said container.

Although the described system allows self-alignment between the two units, the presence of numerous ball joints disadvantageously determines considerable maintenance of the latter over time, constant greasing and preventive replacement of the joints given the heavy operating conditions to which they are subjected.

Centring the container and the support ring is also important in order to conveniently allow the thermal deformations or expansions of the container due to the high temperatures reached during the conversion process.

The need is therefore felt to provide an oxygen converter which allows the aforementioned drawbacks to be overcome.

SUMMARY OF THE INVENTION

The primary object of the present invention is to provide as oxygen converter provided with a suspension system for the container, connecting said container to its own support ring, which does not require maintenance, allowing scheduled and unscheduled operations to be eliminated and reducing to zero the replacement of elements subject to wear. Another object of the invention is to provide an oxygen converter, in which the container suspension system is capable of maintaining a precise centring between container and support ring during all the operating steps of the converter.

Another object of the present invention is to provide a converter, the suspension system of which is capable of absorbing the thermal dilatations of the container with respect to the support ring thereof.

A further object of the present invention is to provide a converter, the suspension system of which is capable of absorbing the vibrations induced by the melting process.

Therefore, the present invention suggests to achieve the above-discussed objects by providing a tilting converter which, in accordance with claim 1, comprises a container defining a first axis X; a support ring, coaxial to the container and spaced from said container, provided with two diametrically opposed supporting pins, defining a second axis Y orthogonal to the first axis X, adapted to allow a rotation of the converter about said second axis; suspension elements, connecting said container to said support ring, restrained at a first end to the container and at a second end to the support ring; wherein said suspension elements are a plurality of elastic bars clamped at said first end and at said second end; and wherein said plurality of elastic bars comprises

- three groups of first elastic bars arranged parallel to the first axis X, said groups of first bars being arranged substantially equally spaced apart from each other along said support ring;
- at least two pairs of second elastic bars, each pair of said second bars being arranged on a respective plane parallel to a first plane Y-Z orthogonal to the first axis X, where Z is an axis orthogonal to a second plane X-Y and passing through the point of intersection between first axis X and second axis Y;
- wherein each pair of second bars is symmetrically arranged with respect to a third plane X-Z;
- and wherein the second elastic bars of each pair are arranged with the respective longitudinal axes converging to each other.

In an advantageous embodiment, there are provided a total of ten or twelve clamped elastic bars, i.e. clamped against rotation; six first bars arranged for a support in a vertical position and four or six second bars arranged for the horizontal support of the converter. The vertical support solution is considered isostatic and includes a number of three supports at 120°, each with a double tie-rod.

In other advantageous embodiments, there are provided three groups of first bars for a support in a vertical position, arranged at 120° to one another, each group being formed by the same number of bars, variable between three and five.

Therefore, the total number of pairs of second bars for the horizontal support, symmetrically arranged with respect to the plane X-Z, also increases from a minimum of four pairs to a maximum of seven pairs.

In all the embodiments, the second bars of each pair are arranged with the respective longitudinal axes converging to each other.

Furthermore, all the embodiments can be provided with a third elastic bar, arranged so as to be diametrically opposite (180°) to the group of first bars arranged close to the plane X-Z.

In particular, the suspension system for the converter, object of the present invention, by means of the elastic bars clamped at the ends, has the following advantages:

- it allows the thermal dilatations of the container to be easily absorbed, taking advantage solely of the elasticity of said bars;
- it efficiently absorbs the vibrations which are generated during the insufflation of oxygen into the container;
- it efficiently absorbs the forces generated by the inertia of the container when starting and ending its rotation;
- it does not require any maintenance as compared to traditional systems which use ball joints and pins which are subject to wear, saving hours of maintenance and plant standstill;
- it keeps the container centred with respect to the support ring with high precision in all inclination conditions;
- the absence of members and joints which are subject to slipping, with a sliding between coupled surfaces, prevents problems in re-positioning the converter when it returns to working condition, with axis X in vertical arrangement and loading mouth facing upwards;
- the slight bending stiffness of the elastic bars allows to limit the bending load on the bars generated by the container dilatations;
- the fixed beam configuration allows heavy loads to be supported, even with a strut configuration of the tie-rods;
- it requires extremely simple assembly;
- they are suitable for all sizes of converters, with the diameter thereof varying, for example, from about 5 m to about 8 m and the height varying from about 7 m to about 11 m.

The excellent precision of the centring between container and support ring allows the thermal expansions of the container, caused by the high temperatures reached during the conversion process, without any interference between container and support ring.

All the suspension elements present in the converter of the invention are long-limbed elastic bars, in which two dimensions are negligible as compared to the third dimension which is the length or longitudinal extension; all of said long-limbed elastic bars having the two ends integrally fixed to the container and the support ring, respectively.

Furthermore, with all the elastic bars preferably being of equal dimensions (both length and diameter, in the case of circular section bars), there is also a greater economic advantage and a smaller number of spare parts to keep in stock.

A further advantage is that the whole structure of the converter, protuberances included, is configured so as to be inserted within a sphere, the radius of which is determined by the layout requirements of the plant comprising the converter.

The dependent claims describe preferred embodiments of the invention.

BRIEF DESCRIPTION OF THE DRAWINGS

Further features and advantages of the invention will become clearer in light of the detailed description of preferred but not exclusive embodiments of an oxygen converter, shown by way of non-limiting example with the aid of the attached drawings in which.

The reference numbers in the figures identify the same elements or components.

DETAILED DESCRIPTION OF THE INVENTION

Figure 1:
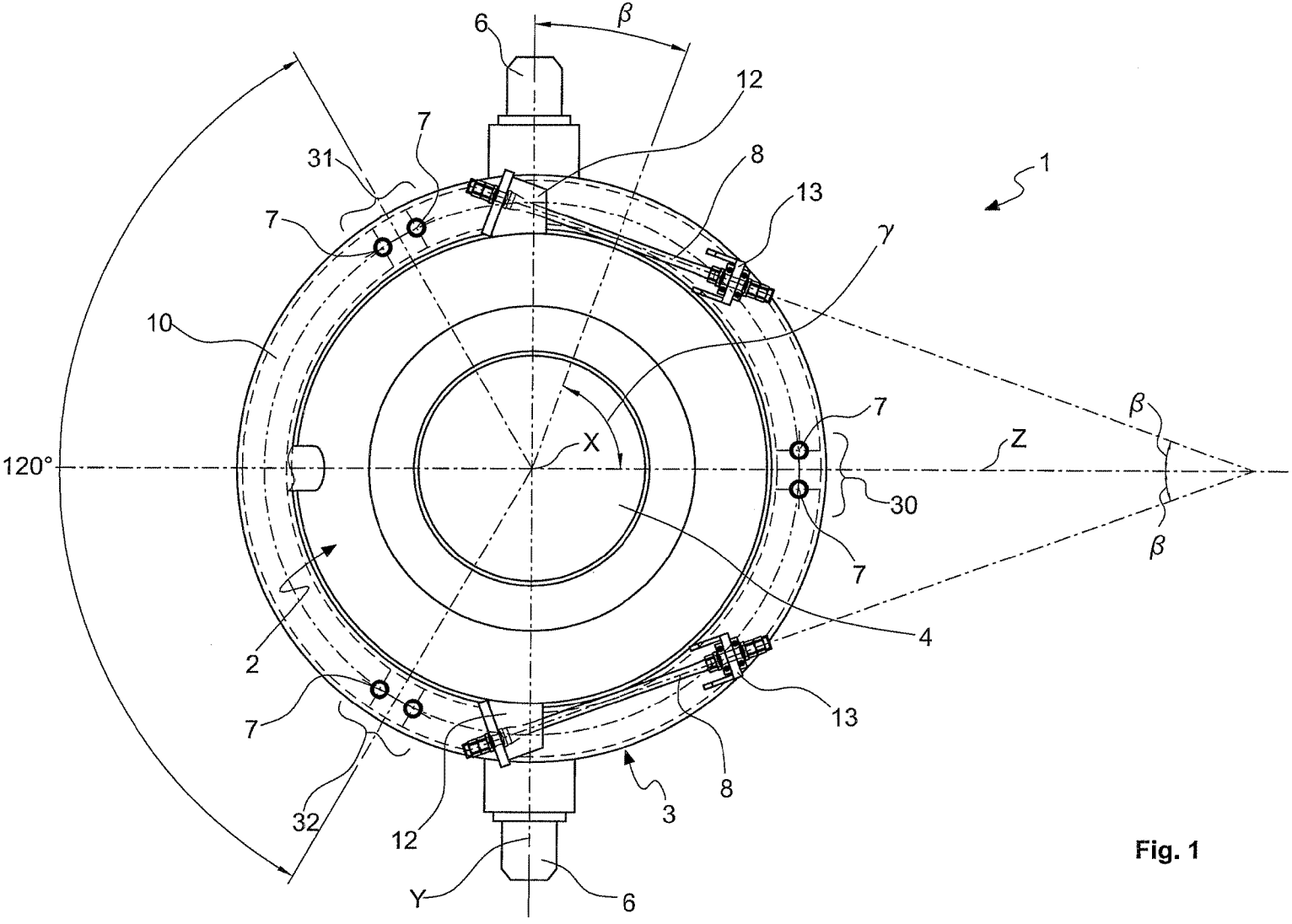
FIG. 1 represents a top view of a first embodiment of an oxygen converter according to the invention.

With reference to the figures, a preferred embodiment of an oxygen converter is represented, globally indicated with the reference number 1.

Said converter 1 comprises:

a container or tank 2, defining an axis X, provided with a loading month 4 for scrap metal and liquid cast iron and provided with a lateral tapping hole 5 for the liquid steel obtained at the end of the conversion process;

a support ring 3 for supporting container 2, said ring 3 being arranged coaxial to container 2 and suitably spaced therefrom;

two supporting pins or tilting pins 6 of said support ring 3, or "trunnions", diametrically opposed to each other and defining an axis Y, orthogonal to axis X, with at least one of said supporting pins 6 connected to a tilting mechanism (not shown);

suspension elements, which connect container 2 to support ring 3 and which also carry out a centring function between container and ring.

Defining a further axis Z as the axis orthogonal to the plane X-Y and passing through the point of intersection of axes X and Y, a plane Y-Z, which can be considered an "equatorial" plane of the converter, and a plane X-Z, both the planes orthogonal to the plane X-Y, are identified.

Container 2 comprises a cylindrical central area 20 and two truncated cone areas 21, 22, each truncated cone area being arranged laterally to said cylindrical central area. A first truncated cone area 21 is welded at one end to said cylindrical central area 20 while at the other end if comprises the loading mouth 4 of the container. A second truncated cone area 22 is welded at one end to said cylindrical central area 20, on the opposite side with respect to the first truncated cone area 21, while at the other end it comprises the bottom 2' of container 2.

Support ring 3, arranged at central area 20 of container 2, is hollow and preferably has a rectangular cross-section. Ring 3 has a first surface 10 facing the part of the container comprising loading month 4; a second surface 11, opposite the surface 10, facing the part of container 2 comprising the bottom 2' thereof; a third internal surface lacing the central part of the container; a fourth external surface opposite the internal surface.

The suspension elements are advantageously bars which are clamped, at a first end to container 2 and at a second end to support ring 3. The bars are locked at the ends to prevent parts from relatively moving and, with no parts subject to wear, maintenance activity is eliminated or at least notably reduced. The bars, acting as tie-rods or struts, are adjustable in order to compensate possible non-uniformity of the length of the bars, thus ensuring the correct positioning thereof.

Said bars are suitably dimensioned in order to operate as elastic support means to absorb the dilations.

Said bars preferably have a circular section. However, other section shapes can be provided according to the designed longitudinal extension of the bars.

The bars are advantageously made from high-alloyed steels, such as steel for springs with high yield stress values or other suitable steel with similar characteristics of elasticity. Furthermore, the bars can be thermally treated (for example by means of hardening and tempering or solution heat-treatment according to the type of steel used) and can be provided with a surface coating, e.g. consisting of nickel, chrome or another appropriate element. The fine material used allows very high resistance not only to mechanical stress but also to the phenomena of oxidation, of notable importance in the context of oxygen converters.

Figure 7A:
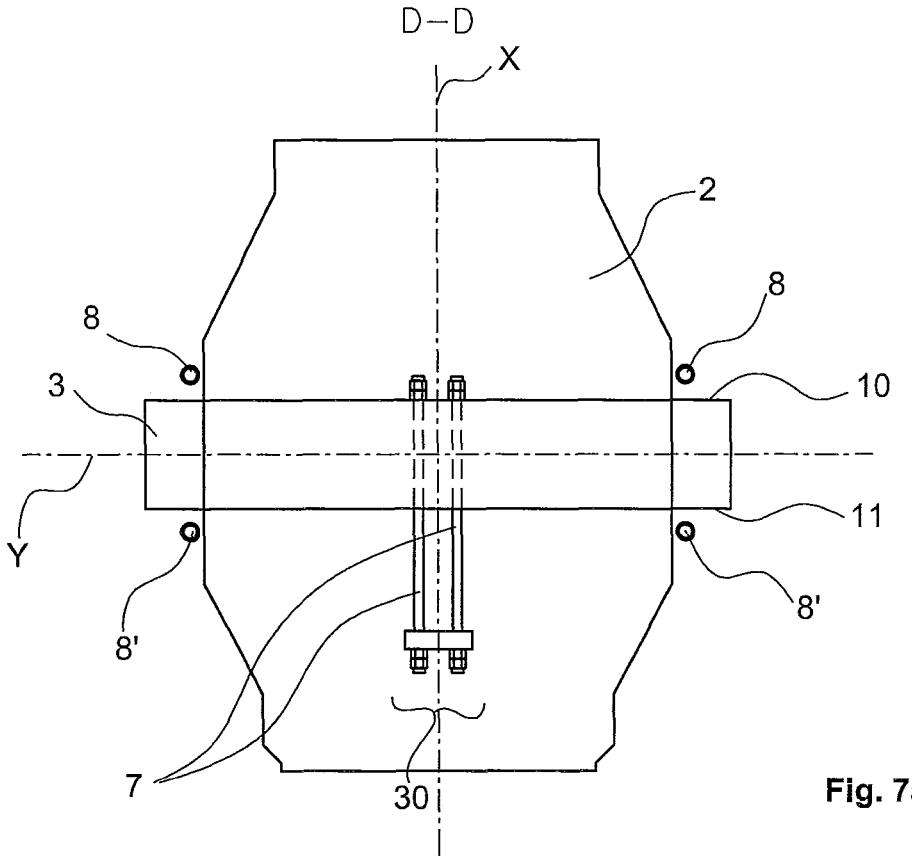
FIGS. 7*a* and 7*b* represent a side view and a top view, respectively, of a second embodiment of the converter of the invention.
Figure 7B:
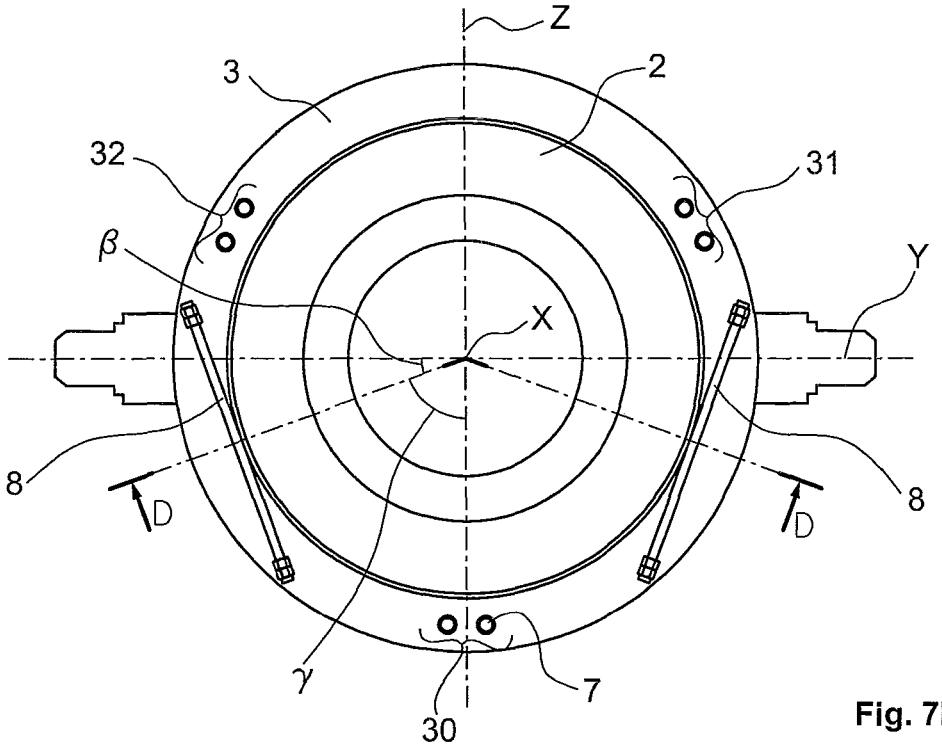
Figure 7C:
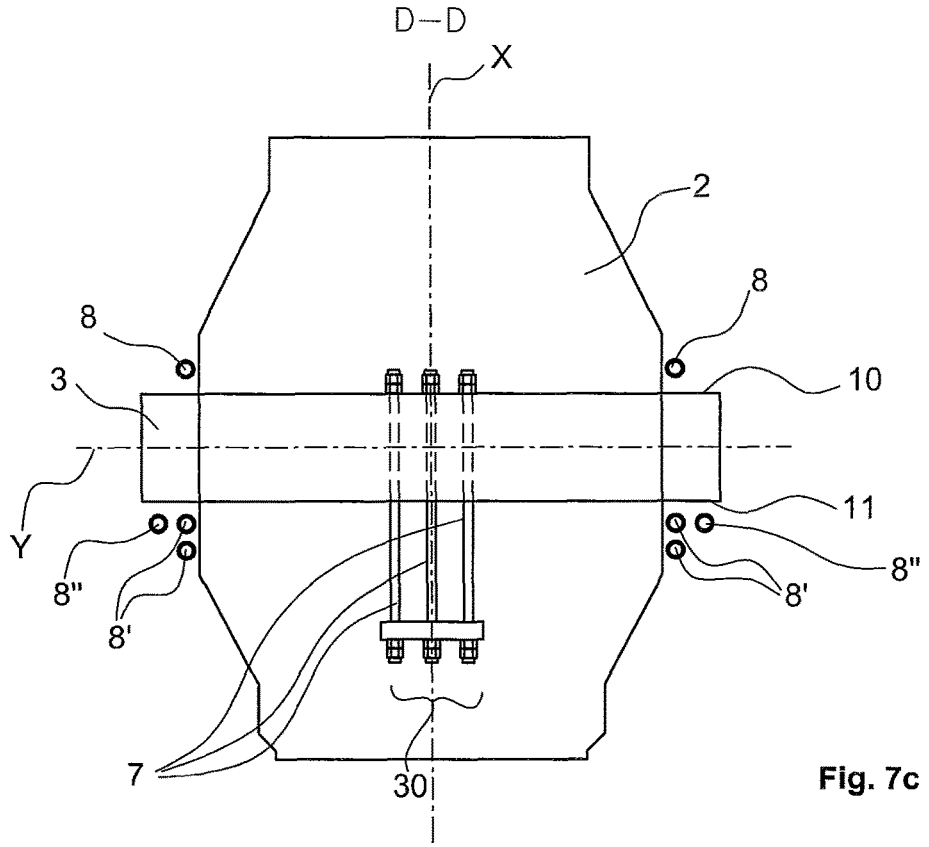
FIGS. 7*c* and 7*d* represent a side view and a top view, respectively, of a third embodiment of the converter of the invention.

With reference to FIGS. 7*a* and 7*b*, which show the converter of the invention in its upright position with loading mouth 4 facing upwards, a first advantageous variant of the invention includes:

three pairs of first elastic bars 7 arranged parallel to axis X and at an equal angular distance between one pair and the next (120°);

two pairs of second elastic bars 8, 8' each pair of said second bars being symmetrically arranged with respect to the plane X-Z on a respective plane parallel to the plane Y-Z.

Therefore, considering the converter in a vertical position (FIG. 7*a*), the first bars 7 are in a vertical position while the second bars 8, 8' are in a horizontal position. The first bars 7 pass orthogonally through the plane Y-Z. The second bars 8, 8', on the other hand, are parallel to the plane Y-Z and pass, at an end thereof, through the plane X-Y.

Figure 2:
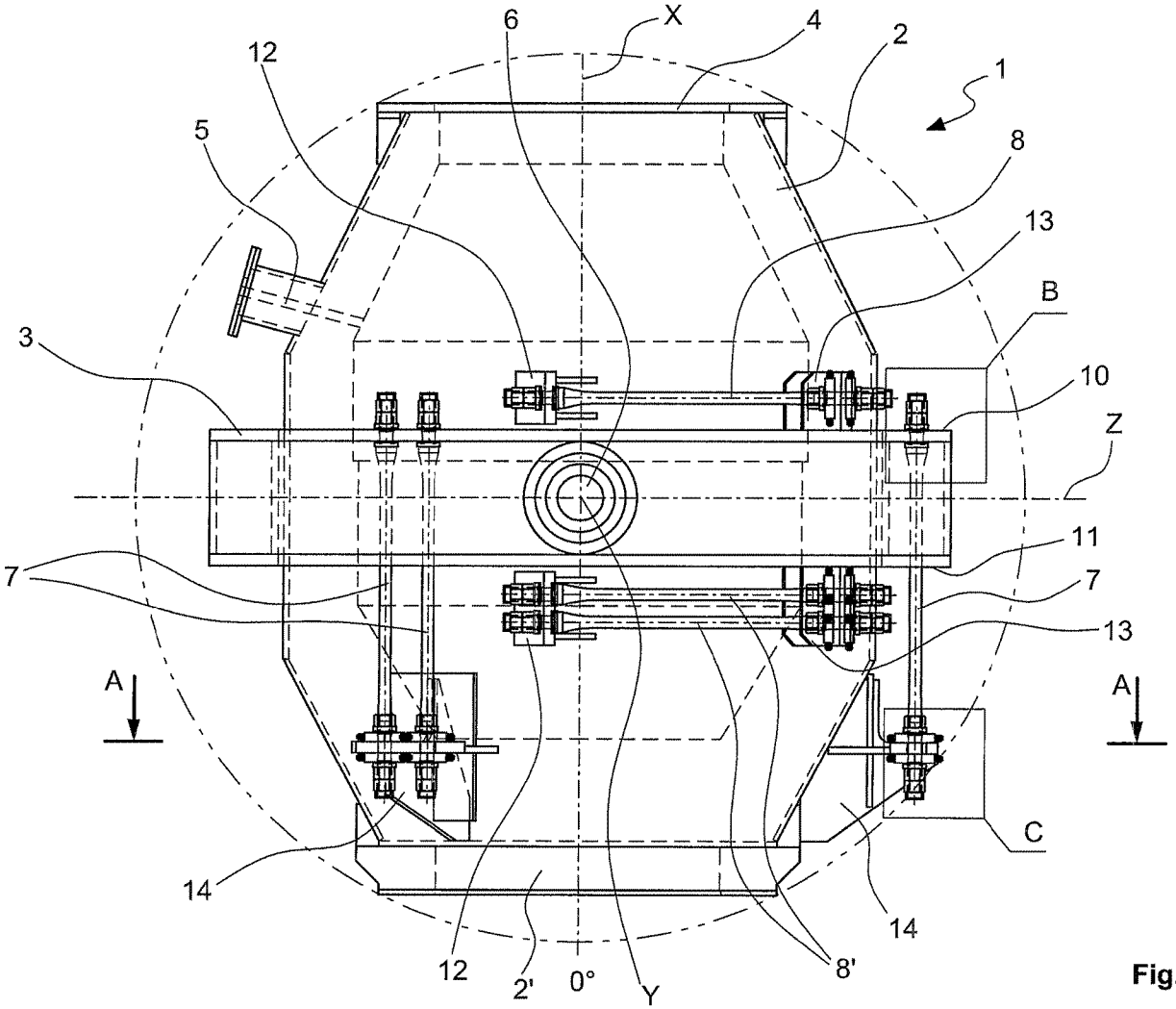
FIG. 2 represents a side view of the converter in FIG. 1 in vertical melting position.

In particular, a pair of second bars 8 is arranged at a first side of the plane Y-Z, i.e. above the plane Y-Z and support ring 3 when the converter is in the upright position (FIG. 2); while a pair of second elastic bars 8' is arranged at a second side of the plane Y-Z, i.e. underneath the plane Y-Z and support ring 3 when the converter is in the upright position (FIG. 2).

In particular, said pair of bars 8 is arranged close to the first surface 10 of the ring, while said pair of bars 8' is arranged close to the second surface 11 of the ring.

Figure 3:
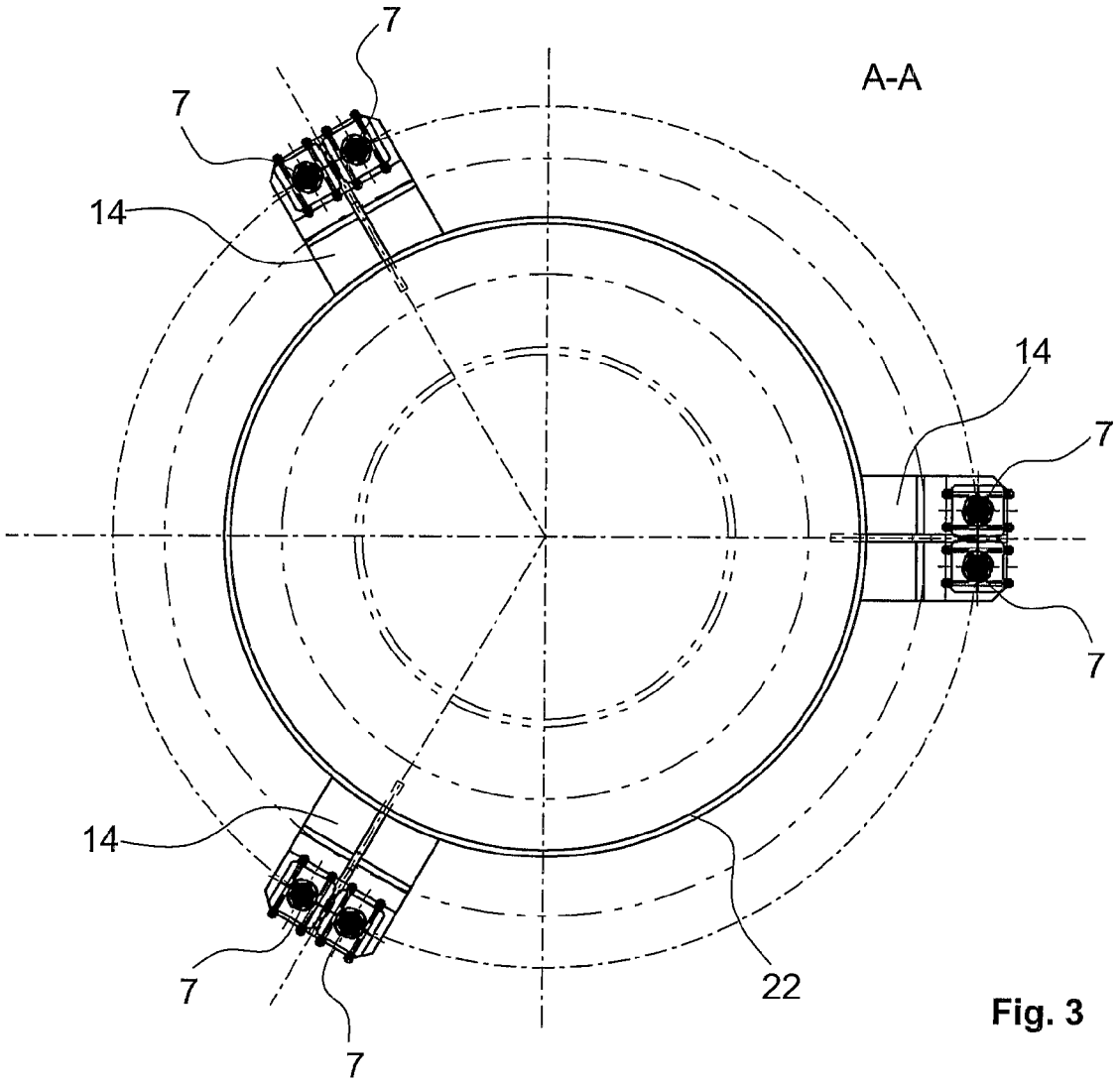
FIG. 3 represents a section view of the converter according to the plane identified in FIG. 2 and FIG. 2*a* by the line A-A.

With reference to FIGS. 1 and 3, which schematically show the converter of the invention in its upright position, a second advantageous variant of the invention includes;

three pairs of first elastic bars 7 arranged parallel to axis X and at an equal angular distance between one pair and the next (120°);

and three pairs of second elastic bars 8, 8', each pair of said second bars being symmetrically arranged with respect to the plane X-Z on a respective plane parallel to the plane Y-Z.

This second variant, in addition to the characteristics described above in the first variant in FIGS. 7*a* and 7*b*, includes a further pair of second bars 8', arranged underneath the pair of bars 8' already provided in the first variant close to the second surface 11 of the ring, so that on each side of the plane X-Z, the three second bars 8, 8' are arranged on the same vertical plane.

In particular, a pair of second bars 8 is arranged at a first side of the plane Y-Z, i.e. above the plane Y-Z and support ring 3 when the converter is in the upright position (FIG. 2); while two pairs of second elastic bars 8' are arranged at a second side of the plane Y-Z, i.e. underneath the plane Y-Z and support ring 3 when the converter is in the upright position (FIG. 2).

In particular, said pair of bars 8 is arranged close to the first surface 10 of the ring, while said pairs of bars 8' are arranged close to the second surface 11 of the ring. In particular, a pair of second bars 8' is proximal to said second surface 11, while the other pair of second bars 8' is distal from said second surface 11.

Other variants of the converter of the invention, on the other hand, include a suspension system comprising a greater number of first elastic bars 7, arranged parallel to the axis X. The number of said first elastic bars can be advantageously increased as a function of the load to be supported. With the increase of the load to be supported, it is preferable to minimize the variation of section or keep the section of the first bars 7 constant, increasing, on the other hand, the number thereof in order to allow them to deform freely by bending.

In the variants in FIGS. 1 and 7*b*, the three pairs of first elastic bars 7 are arranged at 120° to each other in order to have isostatic equilibrium, i.e. a balanced load distribution for each group of elastic bars. This configuration allows excellent results to be obtained for an overall weight of the container of around 340 tons.

In the case of greater loads, rather than to design thicker first elastic bars which would have less elasticity, it is preferable to increase the number of first bars, advantageously including three groups of said first bars 7. These groups of first bars 7 are substantially arranged at 120° to each other in order to continue to have isostatic equilibrium. A greater number of thin bars allows the load to be distributed in an optimal manner, maintaining a suitable elasticity of the bars. Therefore, these other variants of the converter also include a greater number of second elastic bars.

Figure 7D:
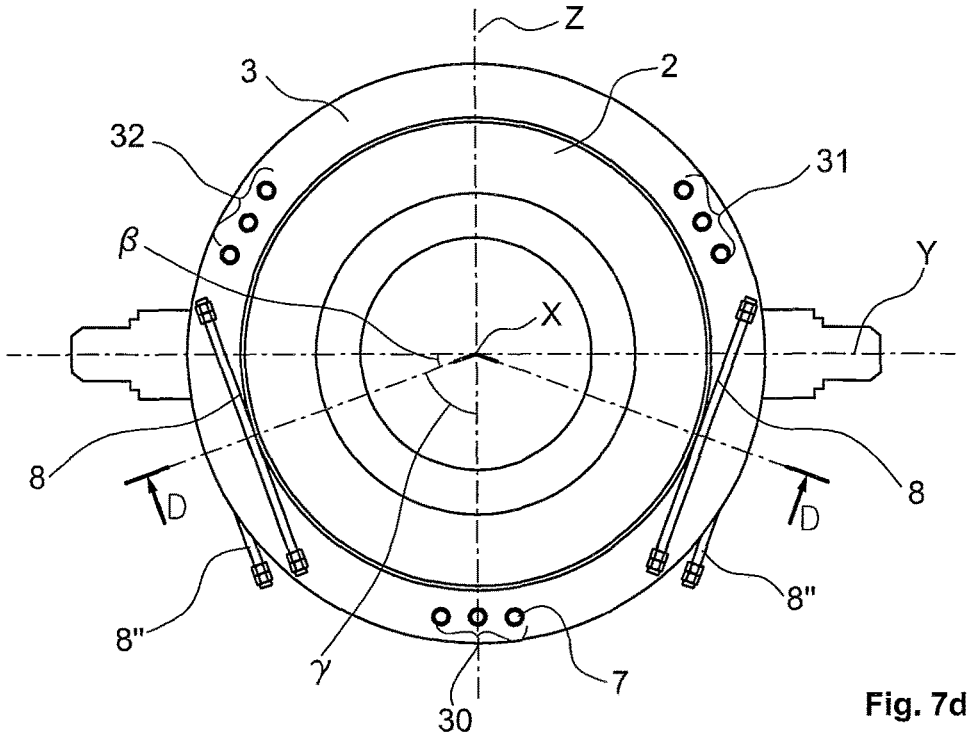
Figure 7E:
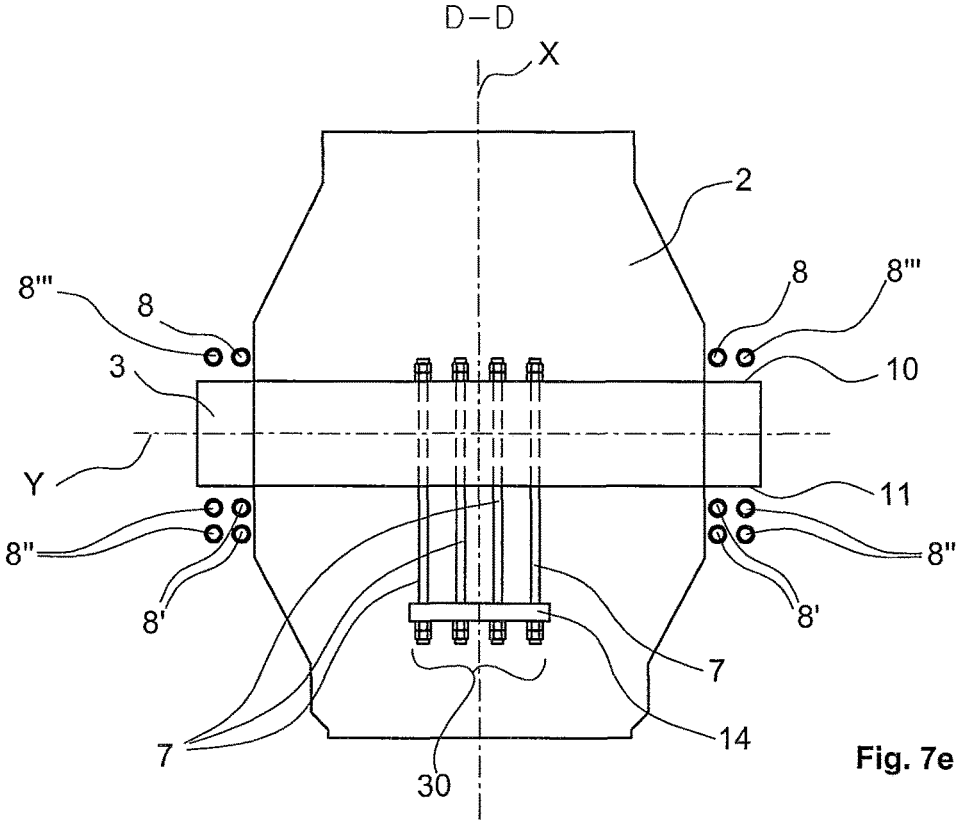
FIGS. 7*e* and 7*f* represent a side view and a top view, respectively, of a fourth embodiment of the converter of the invention.

For example, a third advantageous variant of the converter, schematically shown in FIGS. 7*e* and 7*d* in its upright position, includes three groups 30, 31, 32 of first bars 7, each group consisting of three first bars 7. This third variant further includes four pairs of second elastic bars; a pair of second bars 8 is arranged at a first side of the first plane Y-Z, above support ring 3 when the converter is in a vertical position; three pairs of second bars 8', 8" are arranged at a second side of the first plane Y-Z, underneath support ring 3 when the converter is in a vertical position.

In particular, in addition to the characteristics described above in the second variant in FIGS. 1 and 2, the third variant includes a further pair of second bars 8" arranged close to surface 11 of support ring 3 facing the bottom 2' of the converter. This further pair of bars 8" is arranged on the same plane parallel to the plane Y-Z containing the pair of bars 8' proximal to said surface 11, the bars 8" being arranged externally to the bars 8'.

This configuration allows excellent results to be obtained for an overall weight of the container of around 750 tons.

Figure 7F:
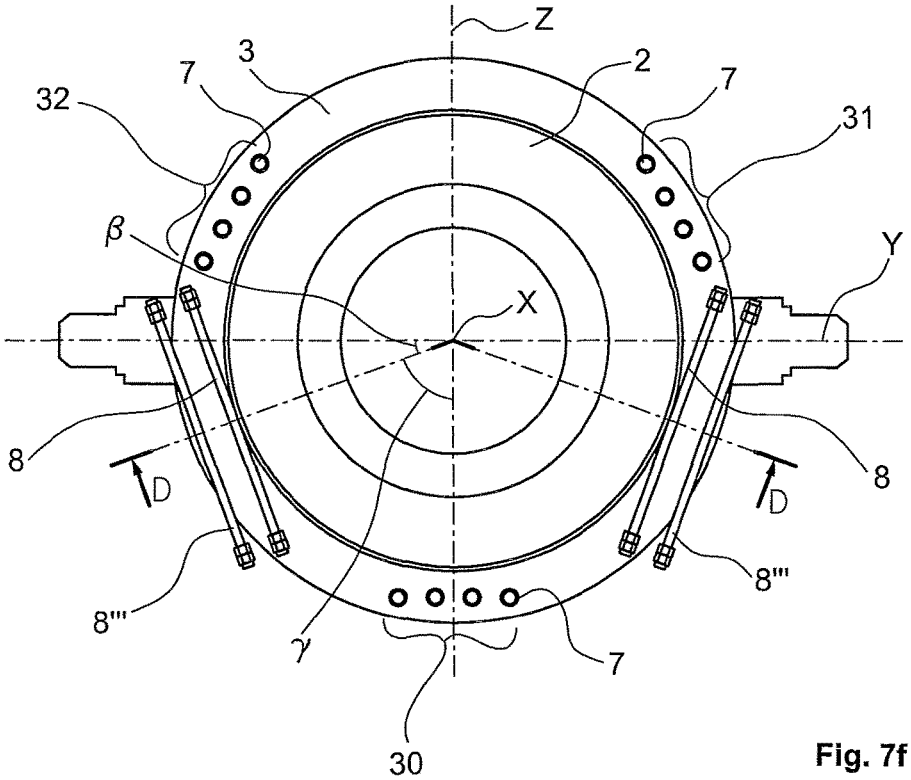

A fourth advantageous variant of the converter, schematically shown in FIGS. 7*e* and 7*f* in its upright position, includes three groups 30, 31, 32 of first bars 7, each group consisting of four first bars 7.

This fourth variant further includes six pairs of second elastic bars: two pairs of second bars 8, 80''' are arranged at a first side of the first plane Y-Z, above support ring 3 when the converter is in a vertical position; four pairs of second bars 8', 8" are arranged at a second side of the first plane Y-Z, underneath support ring 3 when the converter is in a vertical position.

In particular, in addition to the characteristics described above in the second variant in FIGS. 1 and 2, the fourth variant includes:

- a further pair of second bars 8''' arranged close to the surface 10 of ring 3. This further pair of bars 8''' arranged on the same plane parallel to the plane Y-Z containing the pair of bars 8, the bars 8''' being arranged externally to the bars 8;
- two further pairs of second bars 8' arranged close to the surface 11 of support ring 3 facing the bottom 2' of the converter. Each of these further two pairs of bars 8" is arranged on a respective plane parallel to the plane Y-Z and containing a respective pair of bars 8', the bars 8" being arranged externally to the bars 8'.

This configuration allows excellent results to be obtained for an overall weight of the container of around 1100 tons.

Figure 7G:
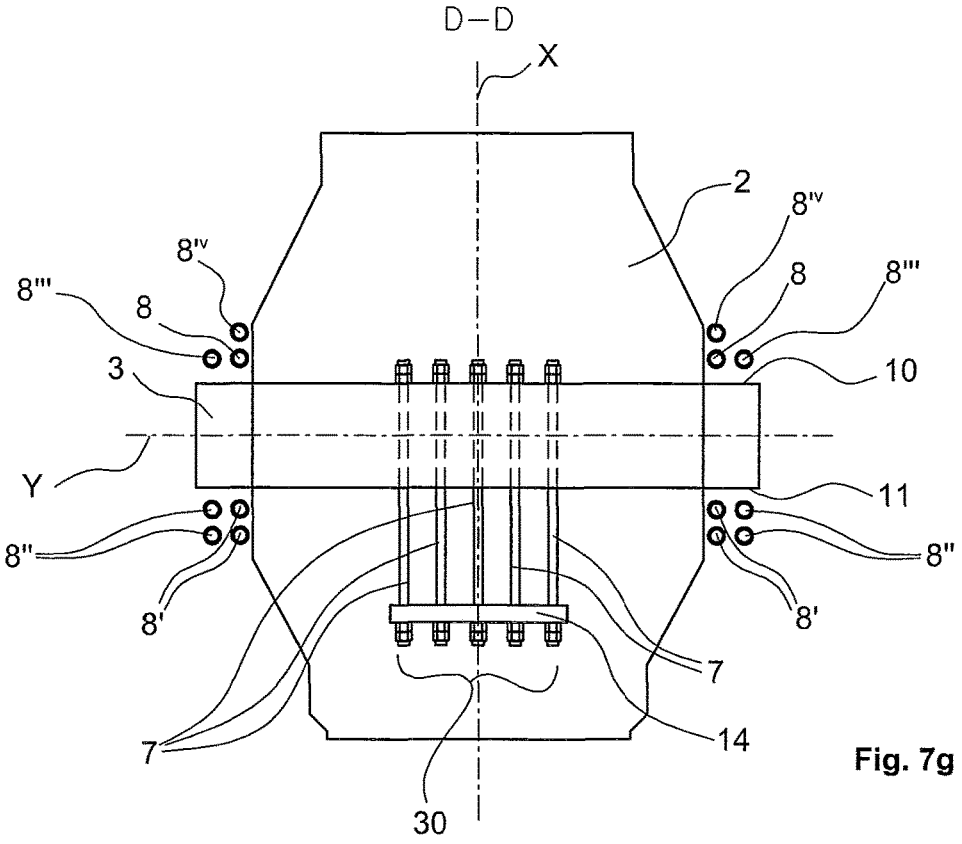
FIGS. 7*g* and 7*h* represent a side view and a top view, respectively, of a fifth embodiment of the converter of the invention.
Figure 7H:
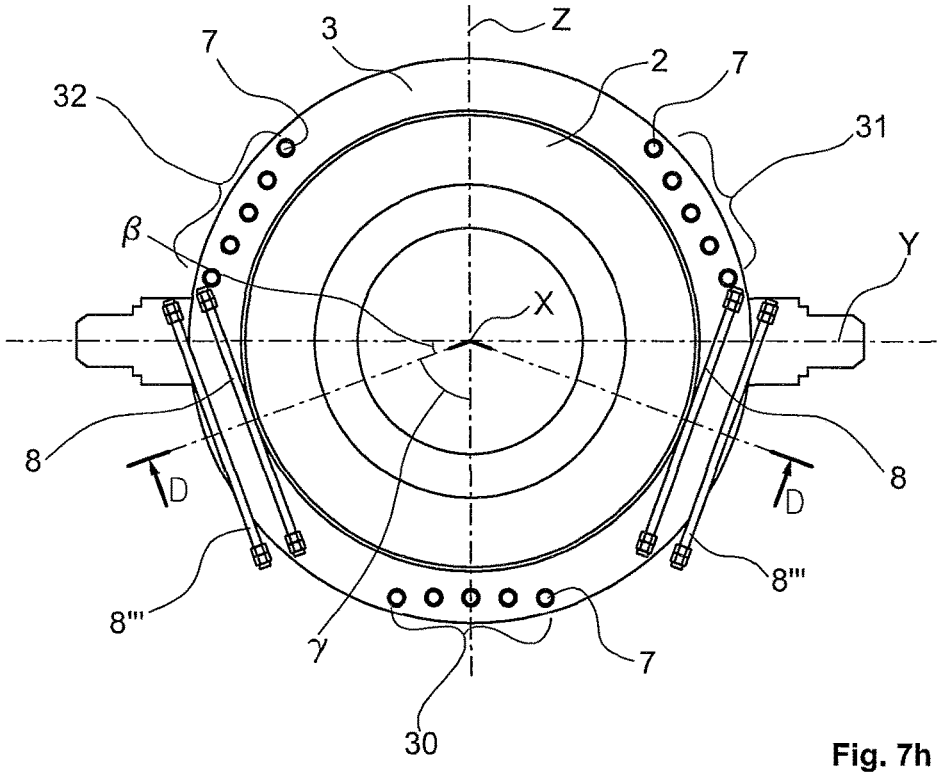

A fifth advantageous variant of the converter, schematically shown in FIGS. 7*g* and 7*h* in its upright position, includes three groups 30, 31, 32 of first bars 7, each group consisting of five first bars 7.

This fifth variant further includes seven pairs of second elastic bars: three pairs of second bars 8, 8''', 8$^{iv}$ are arranged at a first side of the first plane Y-Z, above support ring 3 when the converter is in a vertical position; four pairs of second bars 8', 8" are arranged at a second side of the first plane Y-Z, underneath support ring 3 when the converter is in a vertical position.

In particular, in addition to the characteristics described above in the second variant in FIGS. 1 and 2, the fifth variant includes:

- two further pairs of second bars 8''', 8$^{iv}$ arranged close to the surface 10 of ring 3.

The further pair of bars 8''' is arranged on the same plane parallel to the plane Y-Z containing the pair of bars 8, the bars 8''' being arranged externally to the bars 8; while the further pair of bars 8$^{iv}$ is arranged above the pair of bars 8 so that, on each side of the plane X-Z, the bars 8$^{iv}$, 8 and 8' are arranged on a same vertical plane (FIG. 7*g*);

- and two further pairs of second bars 8" arranged close to the surface 11 of support ring 3 facing the bottom 2' of the converter. Each of these further two pairs of bars 8" is arranged on a respective plane parallel to the plane Y-Z and containing a respective pair of bars 8', the bars 8" being arranged externally to the bars 8'.

On each side of the plane X-Z, the bars 8''' and 8" are also arranged on a same vertical plane (FIG. 7*g*).

This configuration allows excellent results to be obtained for an overall weight of the container of around 1350 tons.

Advantageously, in the case of groups of three or five bars 7, the axis of the bar 7 at the centre of group 30 lies on the plane X-Z (FIGS. 7*d* and 7*h*).

In all the variants of the invention all the first bars 7 are arranged, in plan view, along a circumference. The first group 30 of first elastic bars 7 is arranged close to the plane X-Z. The second group 31 and the third group 32 of the first bars 7 are arranged symmetrically to each other with respect to the plane X-Z. The second elastic bars are arranged at an angular distance γ of ±50÷90°, preferably ±60÷80°, from the plane X-Z.

The second bars 8, 8', 8", 8''', 8$^{iv}$ arranged on one side with respect to the plane X-Z are parallel to each other and are also parallel to said first surface 10 and second surface 11 of ring 3. The same goes for the second bars 8, 8', 8", 8''', 8$^{iv}$ arranged on the other side with respect to the plane X-Z.

The pairs of bars 8', 8", underneath support ring 3 when the converter is in a vertical position, are advantageously arranged closer to the barycenter of the converter in order to support the loads where there is a greater load and a tendency by the converter to rotate.

In order to ensure perfect vertical centring of the converter, the second elastic bars 8, 8', 8", 8''', 8$^{iv}$ of each pair are advantageously arranged on a same plane, parallel to the plane Y-Z, with the respective axes converging to each other in a preferred variant.

Preferably, the angle β, which the longitudinal axis of each elastic bar 8, 8', 8", 8''', 8$^{iv}$ of each pair forms with the plane X-Z on the sheet in FIG. 1, is around 0-40°. Excellent results of self-centring of the converter were obtained with the angle β preferably in the range 10÷30°, limit values included. In the example in FIG. 1, the angle β is equal to around 20°.

All the elastic bars 7, 8, 8', 8", 8''', 8$^{iv}$ are arranged, in plan view, substantially along a circumference (FIGS. 1 and 7). Therefore, they are arranged substantially along the lateral surface of a cylinder.

The second elastic bars are restrained at one end to container 2 and at the other end to support ring 3 by means of locking on respective fixing brackets 12, 13 and 12', 13' (see, for example, FIGS. 1 and 2): hence the constraint is a fixed joint (fixed beam). The fixing brackets 12, 13, 12', 13', welded or bolted to container 2 and ring 13, have through holes into which the bars are inserted; the ends of such bars are threaded and the locking thereof onto the brackets takes plane by means of a self-aligning locking system and nuts. Advantageously, a single fixing bracket 12' and a single fixing bracket 13' can be provided, at each side of the plane X-Z, in order to fix the ends of the elastic bars provided underneath or above support ring 3. The fixing brackets 12, 12' and 13, 13' are provided at the cylindrical central area 20 of container 2. In particular, the fixing brackets 12, 12" are arranged close to the rotating pins 6. In a variant, the second bars 8, 8' are fixed so as to be substantially tangent to a cylindrical surface containing the internal surface of support ring 3 (see, for example, FIG. 1).

The first elastic bars 7 are restrained at one end of container 2 by means of locking on the fixing brackets 14. On the other hand, they are restrained at the other end by means of locking directly onto the first surface 10 of support ring 3. Also in this case, the constraint is a fixed joint (fixed beam). Both the fixing brackets 14, welded or bolted to container 2, and the first surface 10 of ring 3 have through holes into which the elastic bars 7 are inserted; the ends of such bars are threaded and the locking thereof onto the brackets 14 and the first surface 10 of the ring takes place by means of a self-aligning locking system and nuts. The elastic bars 7 pass, at least with one end thereof, through the cavity of ring 3, optionally within a respective sleeve having the function of delimiting the passage channel of the respective bar 7. A single fixing bracket 14 can be advantageously included for each pair or group of elastic bars 7.

With reference to the FIGS. from 1 to 3 and from 7*a* to 7*g* (converter in a vertical position), the first elastic bars 7 are fixed to container 2 in a position underneath support ring 3, i.e. underneath the plane Y-Z; while they are fixed to ring 3 directly on the first surface 10 of the latter, i.e. above the plane Y-Z.

The fixing brackets 14 are advantageously fixed to both the lateral surface of the second truncated cone area 22 of container 2 and to the bottom 2' of the container, delimiting said second truncated cone area. Thereby, it is possible to take advantage of the greater stiffness of bottom 2' having a circular closed structure, without the need of reinforcing the cylindrical area of the container.

In all the variants, the first elastic bars 7 advantageously have a length equal to the length of the second elastic bars 8, 8', 8", 8''', $8^{iv}$. The thickness or diameter can also be equal for all the bars 7, 8, 8', 8", 8''', $8^{iv}$. The elastic bars therefore define tie-rods of equal dimension which are perfectly interchangeable with one another.

As an alternative, however, the length of the first elastic bars 7 is different from the length of the second elastic bars 8, 8', 8", 8''', $8^{iv}$. The thickness or diameter can also be different between the bars 7 and the bars 8, 8', 8", 8''', $8^{iv}$.

In any case, all the bars 7, 8, 8', 8", 8''', $8^{iv}$ are dimensioned so as to have a suitable length and thickness or diameter to operate in the elastic field with infinite duration.

The two supporting pins 6, actuated by at least one tilting mechanism, allow the rotation of the converter about axis Y.

Figure 4:
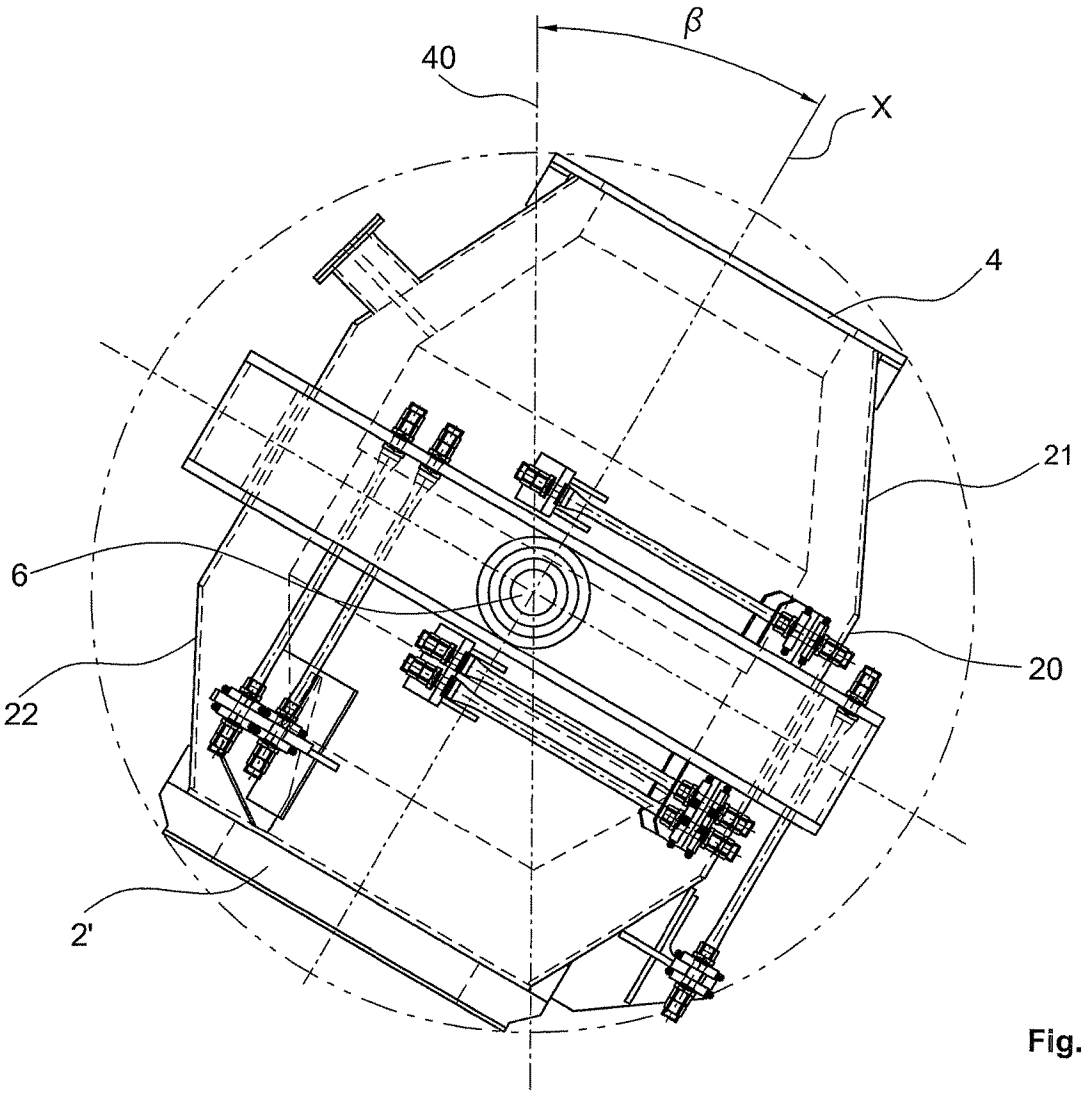
FIG. 4 represents the converter in FIG. 2 in a first operating position for loading cast iron or scrap metal.

The converter usually moves from a first position in which it is in a vertical position with the loading mouth 4 facing upwards (FIG. 2) to a second position inclined by around 30° with respect to the vertical 40 (FIG. 4), by means of rotation of the supporting pins 6 in a first direction of rotation. In the position in FIG. 4, loading of the liquid cast iron and scrap metal takes place through mouth 4.

After loading, the converter returns to the first position in FIG. 2. One or more lances, introduced into the container by means of mouth 4, provide for insufflation of oxygen for a predetermined period of time so as to drastically lower the content of carbon and reduce the concentration of imparities such as sulphur and phosphorus.

Once the conversion into raw liquid steel has been completed, the converter moves from the first position in FIG. 2 to a third position (FIG. 5) inclined by around 90° with respect to the vertical 40, by means of rotation of the supporting pins 6 in a second direction of rotation, opposite to the first one. In this third position, the tapping of the liquid steel takes place by means of tapping hole 5.

In all the variants of the invention, shown in the FIGS. the load, determined by the sum of the weights of container 2, liquid cast iron and scrap metal, is unloaded to the ground by means of support ring 3, the elastic bars 7, 8, 8', 8", 8''' e $8^{iv}$ the tilting pins 6 and the related supports.

In particular, the configuration of the elastic bars 7, 8, 8', 8", 8''', $8^{iv}$ allows the weight to be absorbed for any inclination of container 2.

The first elastic bars 7 act substantially as tie-rods for inclination angles of the converter with respect to the vertical from 0° (position in FIG. 2) to 90° (FIG. 5) and from 270° to 360° (position in FIG. 2); on the other hand, they act substantially as struts for inclination angles of the converter with respect to the vertical from 90° (position in FIG. 5) to 270°.

Figure 6:
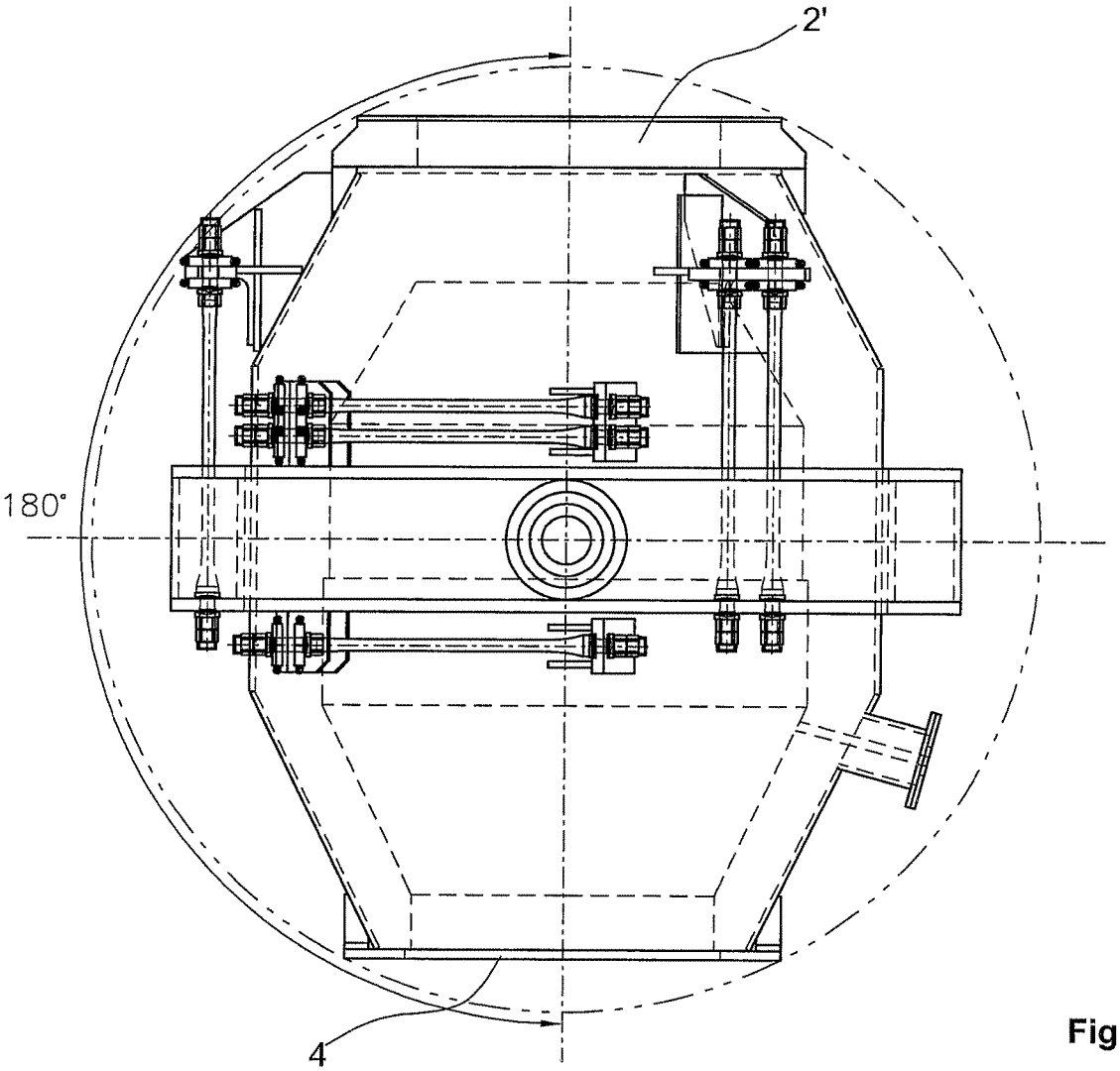
FIG. 6 represents the converter in FIG. 2 in a third operating position for discharging slag.

The position with inclination angle equal to 180°, shown in FIG. 6, with loading mouth 4 facing downwards, is provided for cleaning the container, once emptied.

The pairs of second elastic bars 8, 8', 8", 8''', $8^{iv}$ ensure optimal support, stability and rigidity of the container. Said pairs of second bars 8, 8', 8", 8''', $8^{iv}$ serve principally to support the weight of the container in a direction transverse to axis Y when this is inclined by 90° (tapping position—see FIG. 5). The convergence of the second elastic bars of each pair, in a preferred configuration thereof, also contributes towards absorbing possible loads in the direction of the axis Y. They act substantially as struts for inclination angles of the converter with respect to the vertical from 0° (position in FIG. 2) to 90° (FIG. 5) and from 270° to 360° (position in FIG. 2); on the other hand, they act substantially as tie-rods for inclination angles of the converter with respect to the vertical from 90° (position in FIG. 5) to 270°.

The pairs of second bars 8, 8', 8", 8''', $8^{iv}$ also carry out the function of preventing possible movements/oscillations on the horizontal plane when the converter is inclined by 90° for the step of tapping the liquid steel. With the bars 8, 8', 8", 8''', $8^{iv}$ of each pair being inclined and opposite to each other on a same plane, i.e. converging, they self-centre the container.

In general, therefore, the load on the first elastic bars 7 gradually gees from a maximum value with converter in the vertical position to a zero value with converter in the horizontal position, while the load on the second elastic bars 8, 8', 8", 8''', $8^{iv}$ gradually goes from zero to a maximum value when the converter moves from the horizontal position to the vertical position.

The moments which are generated with the rotation of the converter about axis Y are perfectly absorbed by the configurations of elastic bars of the variants described above.

Figure 1A:
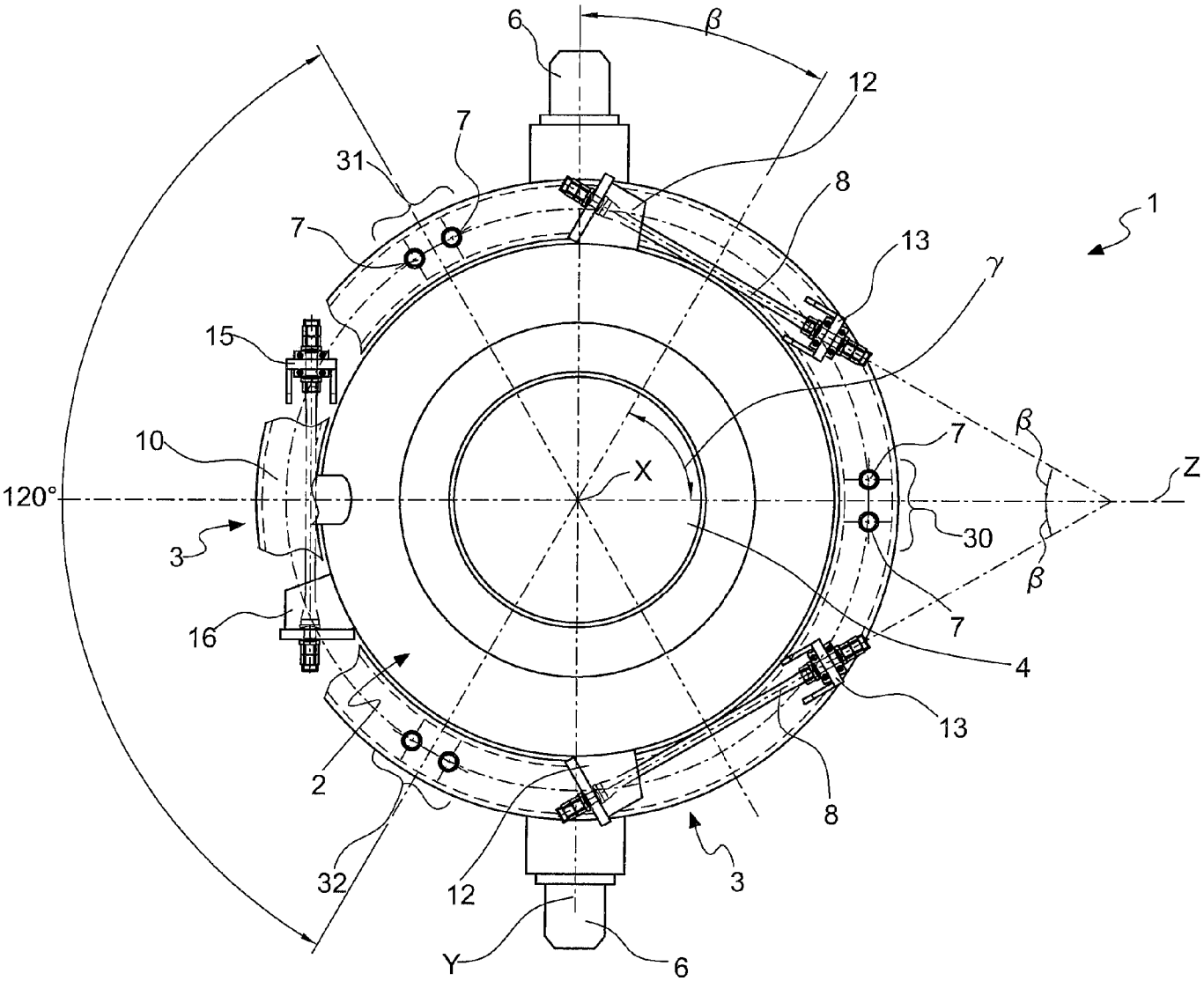
FIG. 1*a* represents a top view of a variant of the converter in FIG. 1.
Figure 2A:
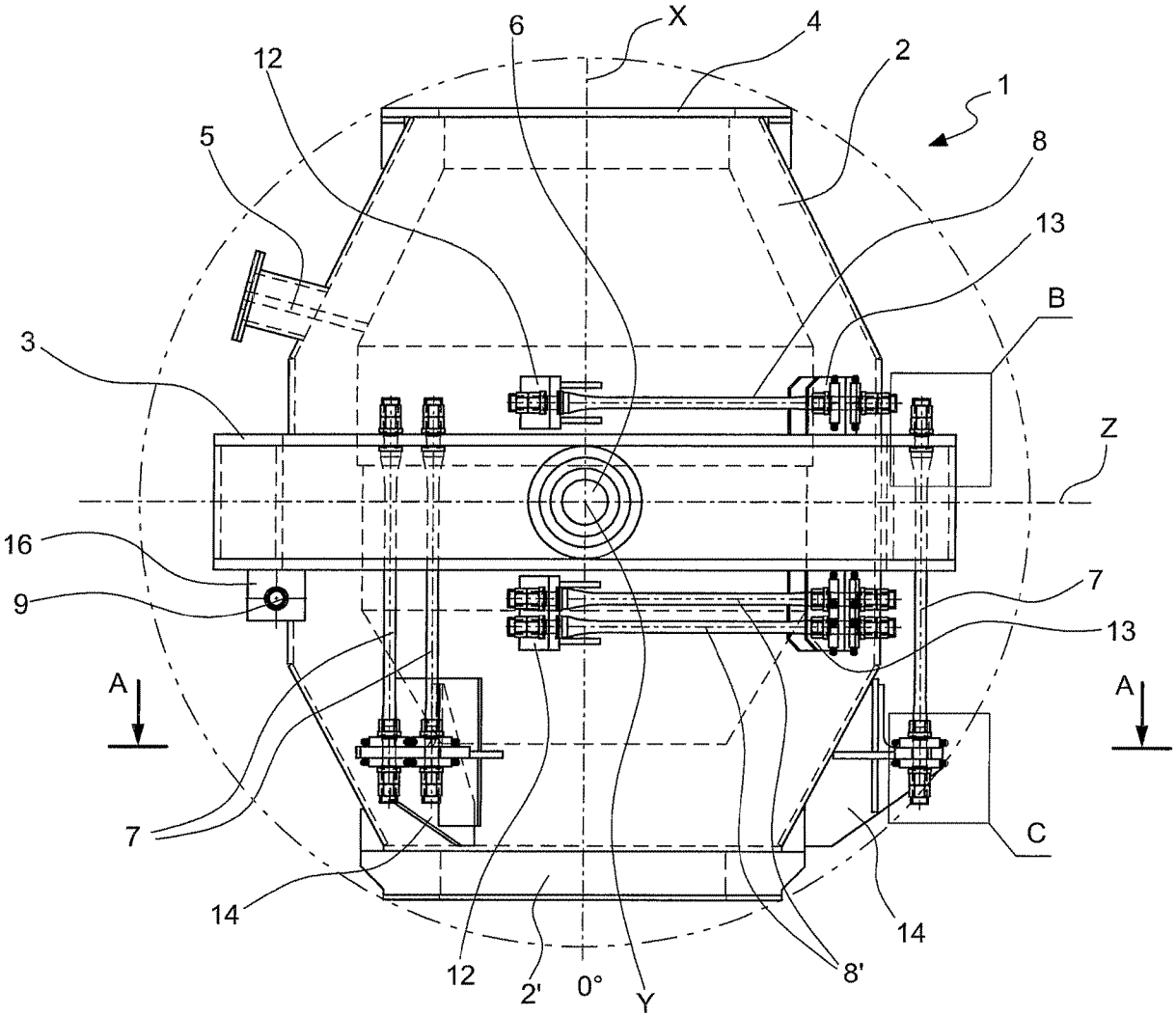
FIG. 2*a* represents a side view of the converter in FIG. 1*a* in vertical melting position.

All the variations described above can be further provided with at least a third elastic bar 9, arranged so as to be diametrically opposite (180°) to the first group 30 of first bars 7 arranged close to the plane X-Z. FIGS. 1*a* and 2*a* show, by way of example, a top view and a side view, respectively, of the converter of the second variant provided with a single third elastic bar 9.

Figure 5:
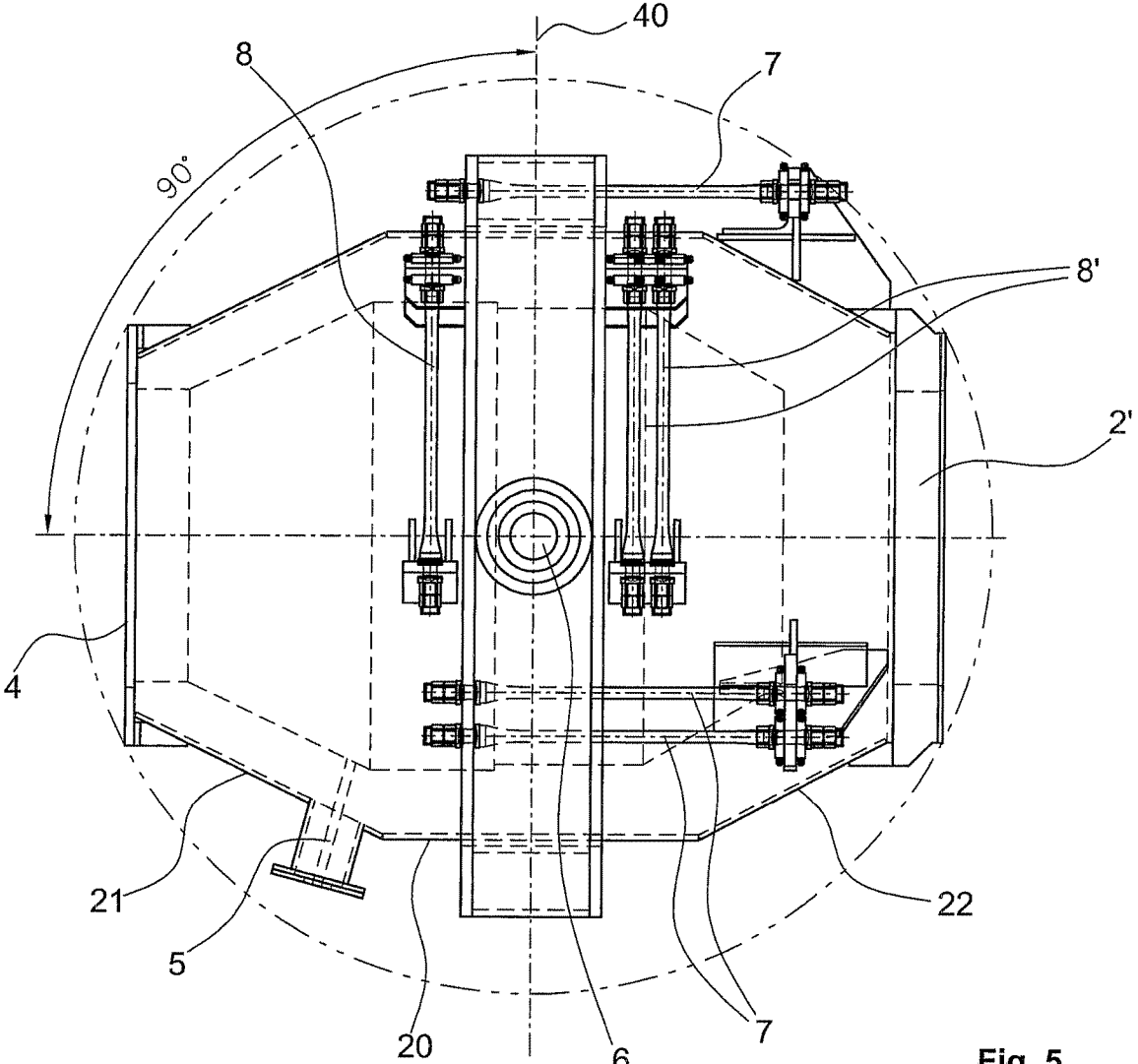
FIG. 5 represents the converter in FIG. 2 in a second operating position for steel tapping.

The third bar 9 is advantageously positioned underneath the plane Y-Z, i.e. underneath support ring 3 when the converter is in the vertical position (FIG. 2*a*), in such a way that it is not exposed to an excessive thermal load during the tapping step (see FIG. 5).

Preferably, but not necessarily, the third bar 9 is positioned equally spaced apart from the second bars 8, 8', 8'', 8''', 8$^{iv}$ provided at both sides of the plane X-Z, preferably at 120° from said second bars, and the angle β, which the longitudinal axis of each second elastic bar of every pair forms with the plane X-Z, is preferably 30°.

The third elastic bar is restrained at one end to container 2 and at the other end to support ring 3 by means of locking on respective fixing brackets 16 and 15 (see, for example, FIG. 1*a*): hence the constraint is a fixed joint (fixed beam). The fixing brackets 15 and 16, welded or bolted to container 2 and ring 13, have through holes into which bar 9 is inserted; the ends of bar 9 are threaded and the locking thereof onto the brackets 15, 16 takes place by means of a self-aligning locking system and nuts.

The task of said at least one third elastic bar 9 is to prevent/block possible lateral movements due to the low frequency vibrations of the container which are generated during the melting step in the vertical position, following the injection of oxygen.

Preferably, the at least one third bar 9 also has the same dimensions as all the other elastic bars present in the converter of the invention. As an alternative, the dimensions of the third bar 9 can be different with respect to the first bars and/or the second bars.

According to a preferred embodiment, in all the above-described variants there is provided only one third elastic bar 9. However, the number of third elastic bars can be greater than one according to the container size. In any case, the third bats 9 are positioned underneath the plane Y-Z when the converter is in the vertical position.

A former advantage is that all the elastic bars 7, 8, 8', 8'', 8''', 8$^{iv}$ are fixed-end bars, provided with an innovative self-aligning locking system, at the two end supports, for the axial closure and compensation of misalignments.

Since both the fixing brackets 12, 12', 13, 13', 14 and the internal and external surfaces of support ring 3 are generally provided fey means of low precision machine tools, they present machining errors which entail very rough parallelism tolerances and/or shape irregularities.

For this reason, the end supports of the bars 7, 8, 8', 8'', 8''', 8$^{iv}$, 9 can have support planes which are not perfectly parallel therefore converging.

For example, taking into consideration the ends of the bars 7 (FIGS. 8 and 9), the first end support 60 (FIG. 8), part of support ring 3, may have the external support surface 10 and the internal support surface 10' not perfectly parallel to each other, causing discontinuous support of the locking elements and consequent clearances which are harmful to the wear resistance and stability of the tie-rod. Taking into consideration also the second end support 60' (FIG. 9), part of fixing bracket 14, the external 40 and internal support surfaces 40' thereof may present machining errors or shape irregularities. Furthermore, there may also be distance errors between the external surface 10 of end support 60 and the external surface 40 of end support 60'.

Figure 15:
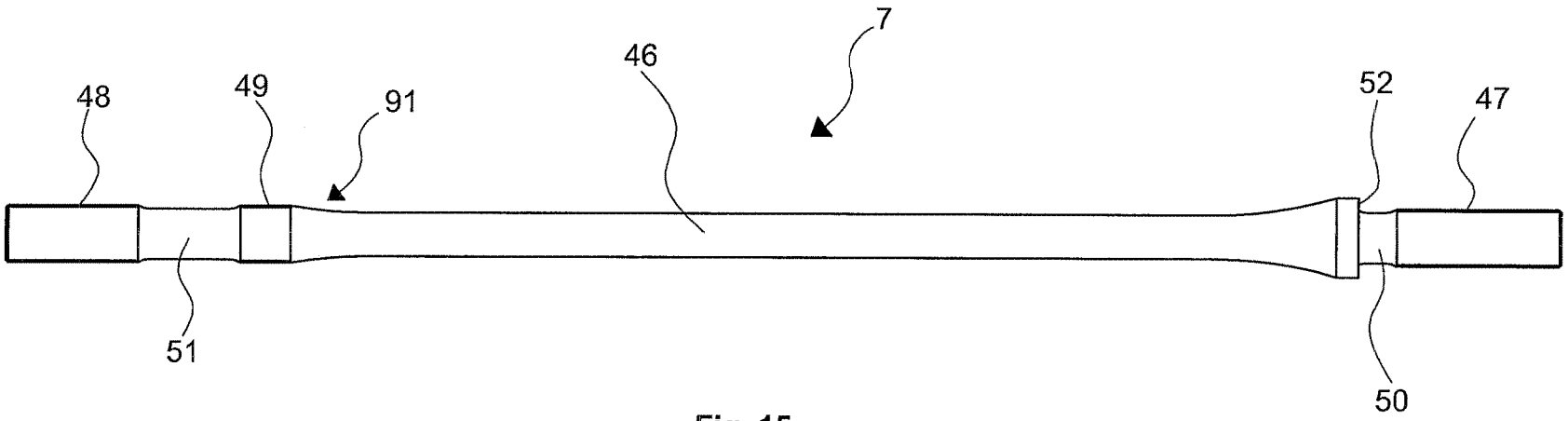
FIG. 15 represents a side view of an element of the component in FIG. 11.

Each tie-rod or strut of the converter of the invention comprises (FIG. 15):

- an elastic bar provided with threaded ends 47, 48;
- locking elements to lock the ends of the bar to respective end supports 60, 60';
- a pair of support flanges or thicknesses 44, 45 which, in the configuration with tie-rod locked at the ends, are arranged at end support 60', said end support 60' being interposed between the two flanges 44, 45.

Bar 7 (FIG. 15) comprises a central portion 46, delimited on one side by a shoulder 52 and on the other by an intermediate threaded portion 49, and two lateral portions 50, 51 having longitudinal extension along axis X which differ from each other.

Figure 8:
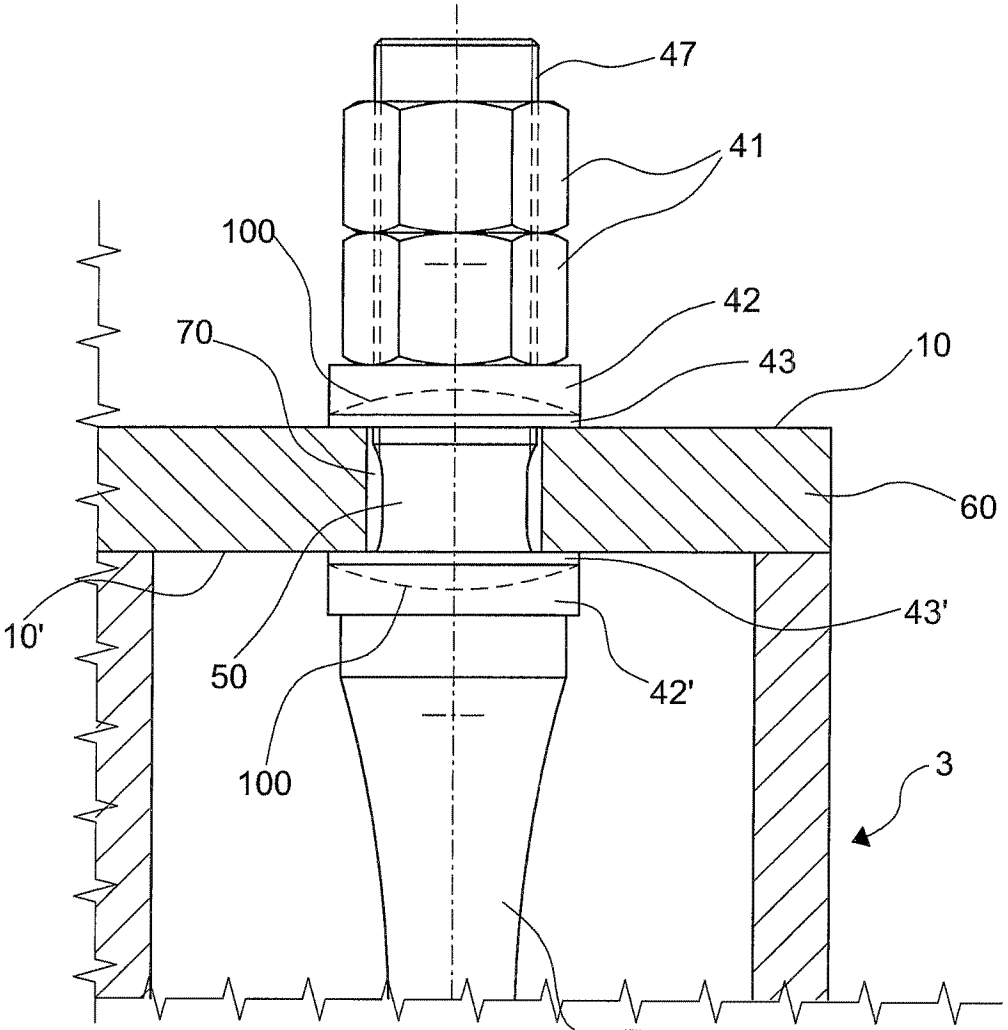
FIG. 8 represents an enlarged section view of a first part of FIG. 2 or FIG. 2*a;*

Lateral portion 50 is arranged between threaded end 47 and the corresponding shoulder 52 and has a longitudinal extension along axis X which is substantially equal to the longitudinal extension of the hole 70 provided its the end support 60 (FIG. 8). The lateral portion 50 has a diameter which is smaller than the diameter of the adjacent threaded end 47.

The lateral portion 51, on the other hand, is arranged between threaded end 48 and said intermediate threaded portion 49, and has a longitudinal extension along axis X which is greater than the longitudinal extension of lateral portion 50 and slightly longer than the sum of the longitudinal extensions of the three holes 80, 90, 90' (FIG. 9), provided in the respective end support 60' and in the two flanges 44, 45, respectively. Lateral portion 51 has a diameter which is smaller than the diameter of the adjacent threaded end 48 and intermediate threaded portion 49.

The locking elements comprise at each end of the bar:

- two pairs of spacers 42, 43 and 42', 43', each pair of spacers advantageously having surfaces joined to each other 53, 54 e 53', 54' substantially in the shape of an annular portion of a spherical cap (FIGS. 14*a* and 14*b*);
- and at least two tightening nuts 41.

In the configuration with tie-rod locked at the ends, at each end support there are provided;

- a first pair of spacers 42, 43 arranged at an external side of the respective end support,
- a second pair of spacers 42', 43' arranged at an internal side of the respective end support.

The first pair of spacers and the corresponding second pair of spacers are advantageously symmetrically arranged with respect to the interposed end support, and the pair of joined surfaces 53, 54 of the first pair of spacers has a spherical cap radius which is equal to the spherical cap radius of the pair of joined surfaces 53', 54' of the second pair of spacers, said pair of joined surfaces, however, being arranged on different spherical surfaces. Each elastic bar is therefore clamped (non-spherical joint) by means of an innovative looking system at the two end supports for the axial closure and compensation of misalignments.

Said at least two tightening nuts 41 are externally tightened onto the first pair of spacers 42, 43, i.e. the external pair of spacers.

Figure 11:
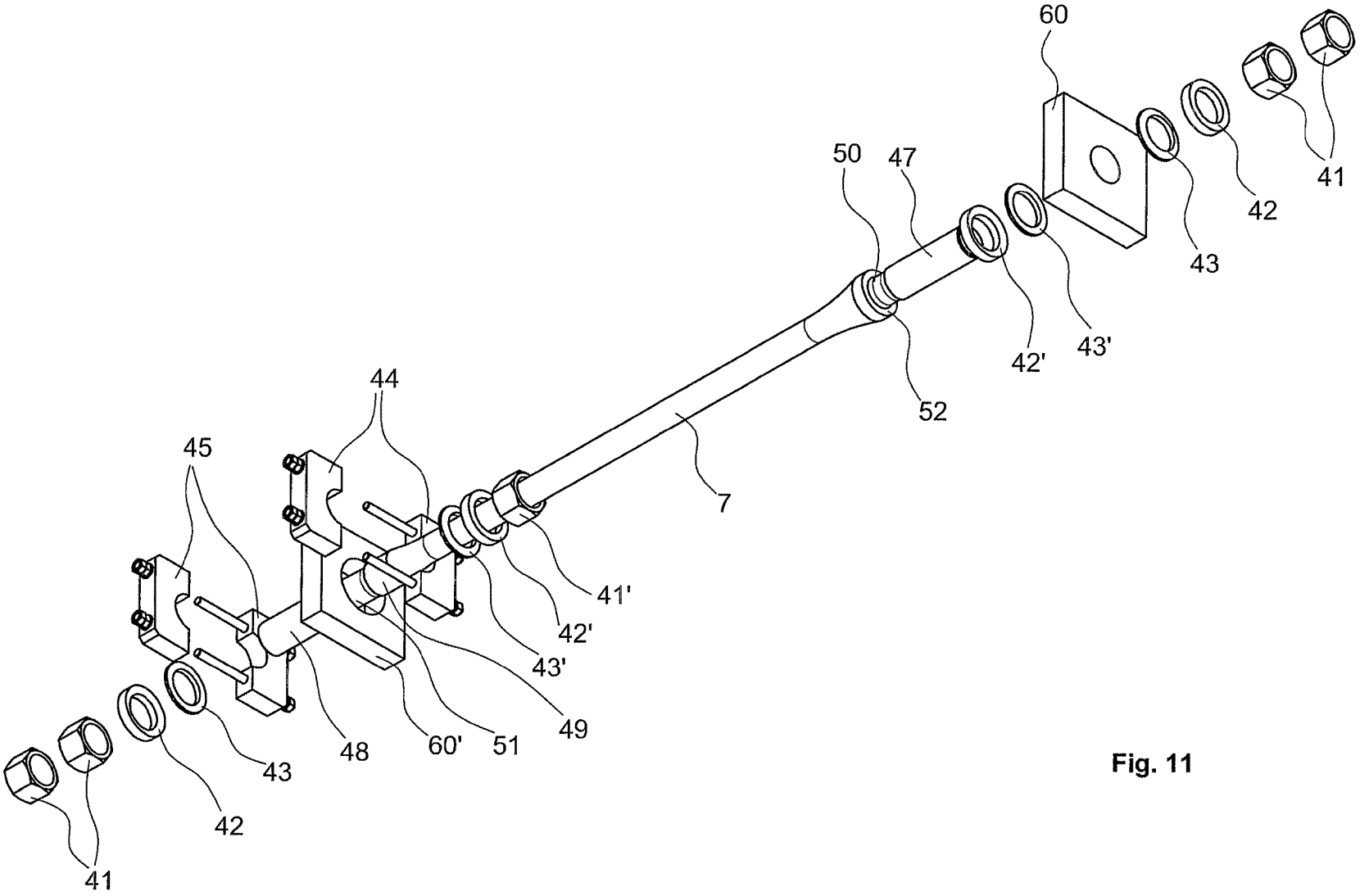
FIG. 11 represents an exploded perspective view of a component of the converter according to the invention.
Figure 12:
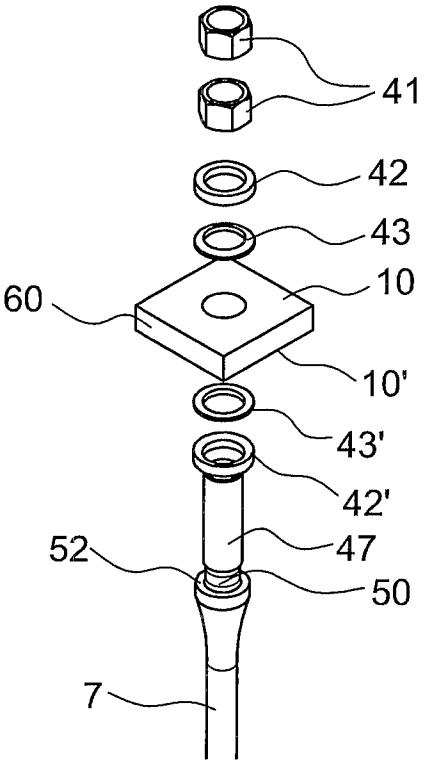
FIG. 12 represents an exploded perspective view of a first part of FIG. 11.
Figure 14B:
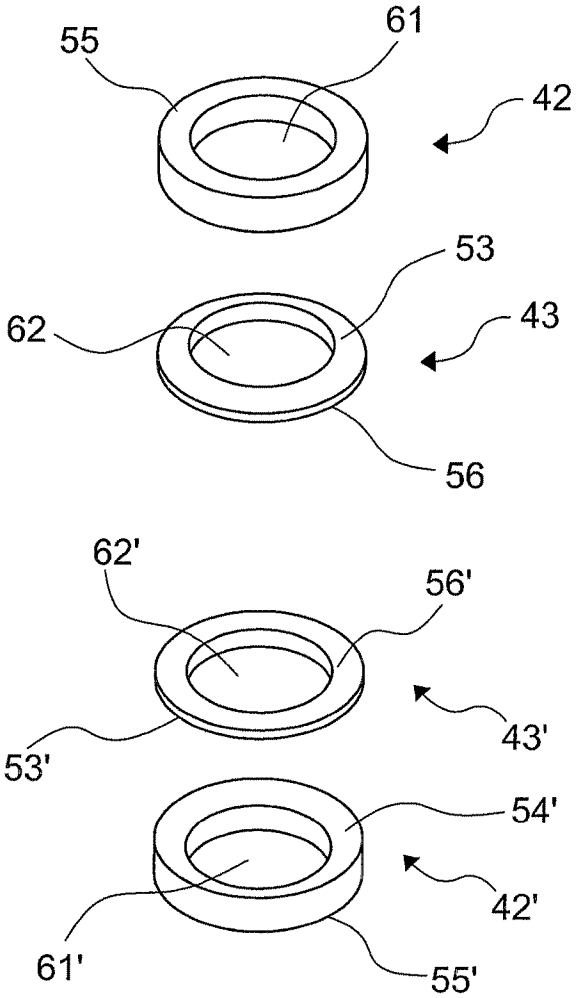
FIGS. 14*a* and 14*b* represent an exploded view, side and in perspective, respectively, of several elements of the component in FIG. 11.
Figure 14A:
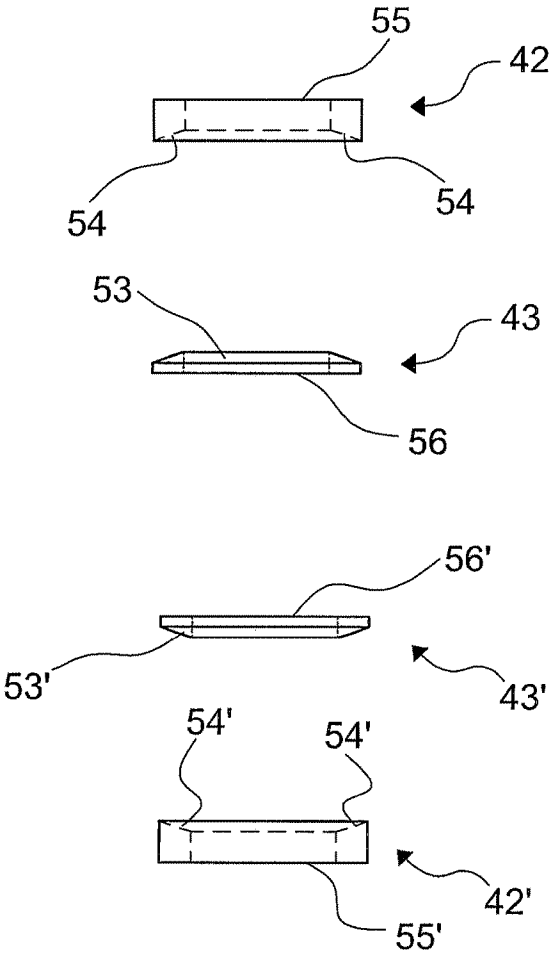

In particular, with reference to FIGS. 8, 11 and 12, the clamping locking system of elastic bar 7 provides at the threaded end 47 of the bar (FIG. 8):

- external tightening nuts 41, e.g. in a minimum number of two, to be tightened on threaded end 47 of bar 7;
- a first external pair of spacers or washers 42, 43, to be arranged between said two tightening nuts 41 and external surface 10 of end support 60; each spacer 42, 43 being provided with a respective hole 61, 62 for passing threaded end 47 of the bar, the spacer 43 having an surface of annular portion of spherical cap 53 joined to a corresponding surface 54 provided in spacer 42 (FIGS. 14*a* and 14*b*);
- a second internal pair of spacers or washers 42', 43', to be arranged between shoulder 52 of bar 7 and internal surface 10' of end support 60; each spacer 42', 43' being provided with a respective hole 61', 62' for passing threaded end 47 of the bar, the spacer 43 having an surface of annular portion of spherical cap 53' joined to a corresponding surface 54' provided in spacer 42' (FIGS. 14*a* and 14*b*);

First end support 60 is provided with a hole 70 for passing a respective end of the bar (FIG. 8).

With reference to FIGS. 8, 12 and 14, spacer 42' rests with a flat surface 55' thereof against shoulder 52, while spacer 43' rests with a flat surface 56' thereof against internal surface 10' of end support 60. Spacer 43, on the other hand, rests with a flat surface 56 thereof against external surface 10 of end support 60, while flat surface 55 of spacer 42 is pressed by the tightening bolts 41.

By tightening the bolts 41 on threaded end 47 of bar 7, the joined surfaces 53', 54' of the spacers 43', 42' and the joined surfaces 53, 54 of the spacers 43, 42, respectively, will come into complete contact with each other, while the flat surfaces 56, 56' will adapt to the shape of the respective surfaces 10, 10' of end support 60.

This clamping locking solution advantageously allows misalignment errors of the surfaces 10, 10' to be compensated for by means of sliding between the joined surfaces with spherical cap shape. The radius of the spherical cap is the same for both pairs of joined surfaces but the centres are different, i.e. the two spherical cap surfaces are not part of the same spherical surface (see curved dotted lines 100 in FIG. 7). Therefore, this configuration of the spacers represents a self-aligning "locked joint", i.e. a joint which cannot work as a ball joint, but when the bar is tightened, necessarily works as a fixed joint.

The joined surfaces with spherical cap shape allow rotation in the assembly step, whereby these surfaces always fit together with each other. The flat surfaces 56, 56' of the spacers 43, 43' will deform following tightening, whereby the contact between said flat surfaces 56, 56' and the support surfaces 10, 10' is maximized so as to obtain a continuous support.

The use of this locking system allows the use of high-precision processing machines to be avoided, and therefore higher production and management costs. Furthermore, this locking system advantageously allows the use of a support ring without any openings in the external lateral surface thereof, which is necessary for accessing the tightening area in the case of state-of-the-art spherically jointed tie-rods, determining a greater mechanical resistance of the ring structure.

Figure 10:
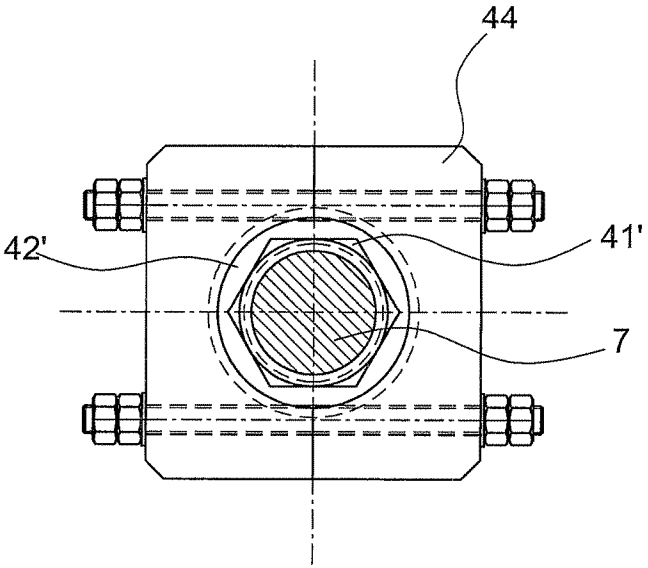
FIG. 10 represents a side section view of said second part of FIG. 2.
Figure 9:
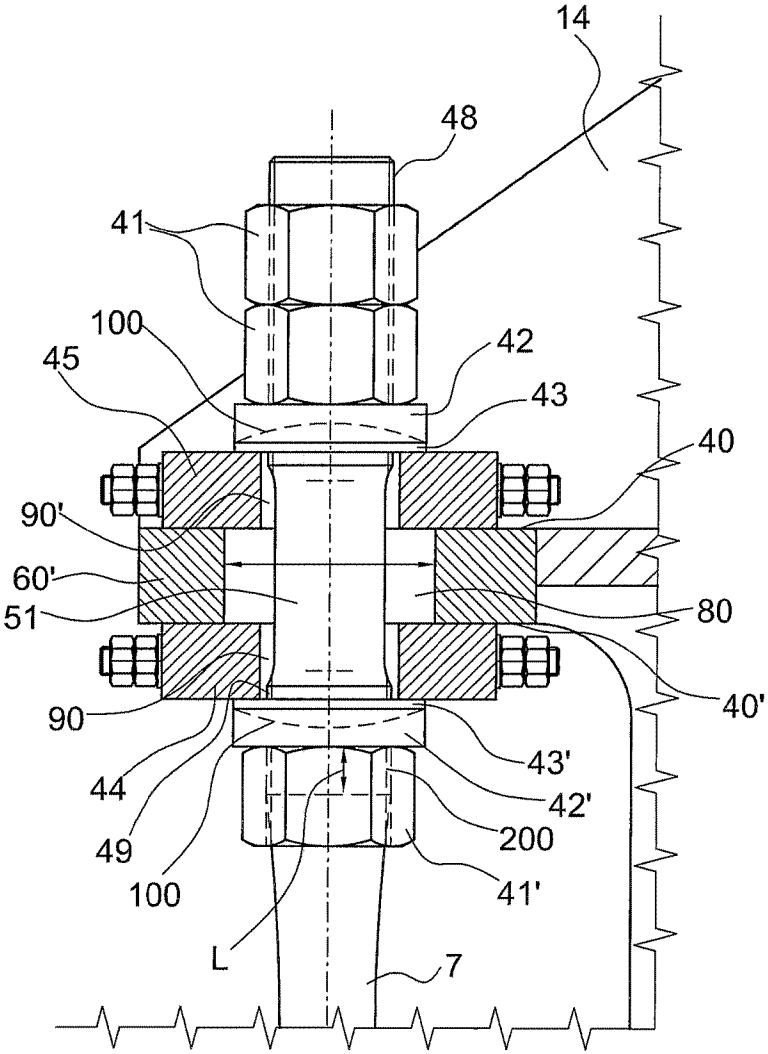
FIG. 9 represents an enlarged section view of a second part of FIG. 2 or FIG. 2*a;*

Instead, with reference to FIGS. 9, 11 and 13, the clamping locking system of the elastic bar includes, at threaded end 48 of the bar (FIGS. 9 and 10):

external tightening nuts 41, e.g. in a minimum number of two, to be tightened on threaded end 48;

two flanges 44, 45, or support thicknesses, to be arranged so that end support 60' is arranged between said two flanges;

a first external pair of spacers or washers 42, 43, to be arranged between said tightening nuts 41 and external flange 45; each spacer 42, 43 being provided with a respective hole 61, 62 for passing threaded end 48 of bar 7, the spacer 43 having a an annular portion surface 53 of spherical cap joined to a corresponding surface 54 provided in spacer 42 (FIGS. 14*a* and 14*b*);

a second infernal pair of spacers or washers 42', 43', to be arranged between internal flange 44 and internal nut 41'; each spacer 42', 43' being provided with a respective hole 61', 62' for passing threaded end 48 of bar 7, the spacer 43' having a an annular portion surface 53' of spherical cap joined to a corresponding surface 54' provided in spacer 42';

an internal nut 41' to be tightened on intermediate threaded portion 49 until resting on the internal pair of spacers 42', 43'.

The first flange 45 is arranged between the external pair of spacers 42, 43 and the respective external surface 40 of end support 60' and a second flange 44 is arranged between the internal pair of spacers 42', 43' and the respective internal surface 40' of end support 60'.

Figure 13B:
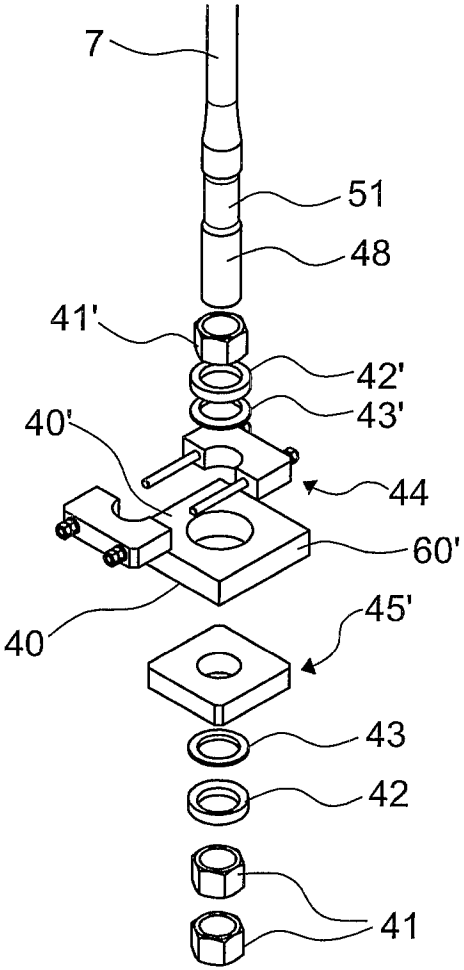
FIG. 13*b* represents an exploded perspective view of the second part of FIG. 11 in an alternative variant thereof.
Figure 13A:
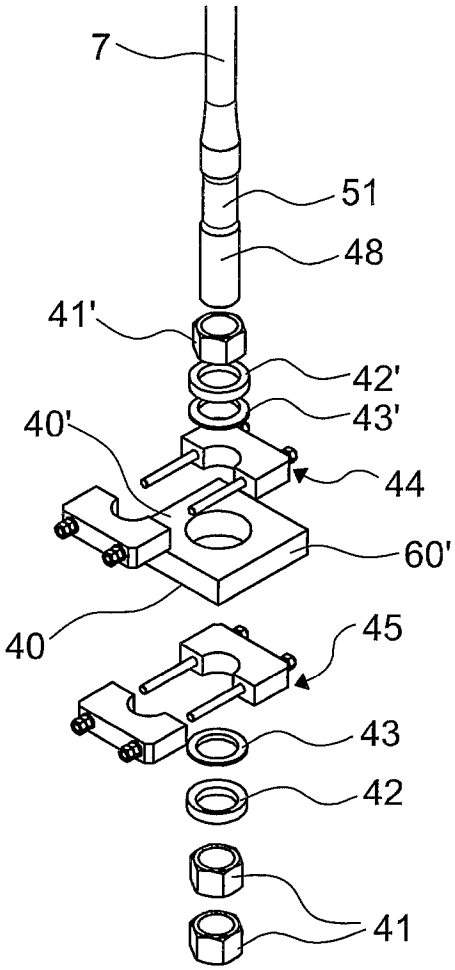
FIG. 13*a* represents an exploded perspective view of a second part of FIG. 11.

Hole 80 of end support 60' has a greater diameter than hole 70 of end support 60. The flanges 44, 45 are provided with respective holes 90, 90' with a smaller diameter than the diameter of hole 80. The flanges 44 and 45 may consist of half flanges (FIG. 13*a*) held integral with each other by means of fixing means, such as stud bolts with nut and lock nut; as an alternative, the external flange is instead provided as an integral component (FIG. 13*b*—flange 45').

With reference to FIGS. 9, 13 and 14, spacer 42' rests with a flat surface 55' thereof against internal nut 41', while spacer 43' rests with a flat surface 56' thereof against a flat surface of internal flange 44. Spacer 43, on the other hand, rests with a flat surface 56 thereof against a flat surface of external flange 45, while flat surface 55 of spacer 42 is pressed by the tightening bolts 41.

By tightening the bolts 41 on threaded end 48 of bar 7 and tightening internal bolt 41' on intermediate threaded portion 49, the joined surfaces 53', 54' of the spacers 43', 42' and the joined surfaces 53, 54 of the spacers 43, 42, respectively, will come into complete contact with each other, while the flat surfaces 56, 56' will put pressure on the flanges 44, 45 which will adapt to the shape of the surfaces 40, 40' of support 60'.

Internal tightening bolt 41' is advantageously configured to be, in the condition of end-locked tie-rod, longer than the length L of the useful part 200 of thread of intermediate threaded portion 49 protruding from spacer 42' towards the inside of bar 7. This allows the prevention of notching stress concentrations due to exposed threads of the part subjected to bending of the bar itself. Once tightened, therefore, internal nut 41' will have exposed threads at area 91 (FIG. 15) into which bar 7 tapers inwardly.

In addition to the advantages derived from the use of pairs of spacers with spherical joined surfaces, already discussed above, the fact of providing internal nut 41', which is completely accessible inasmuch as it is provided on the exterior of support ring 3, allows distance errors to be compensated between the support surfaces, those integral with the container and those integral with the support ring. Internal nut 41' is therefore an adjustment nut in order to compensate these distance errors and adapt the structure to all the variable distances which there may be in the design.

The presence of flanges 44 and 45, defining further spacers, advantageously allows hole 80 to be kept considerably larger than the diameter or thickness of the bar, thus facilitating the passing of the bar and the corresponding assembly of end supports. Thereby, in addition to compensating planarity distance errors, alignment errors between the hole 70 of end support 60 and the hole 80 of end support 60' are also compensated.

Therefore, the above-described locking system for locking the bar to the end supports globally allows remarkable ease of assembly and centring simplicity.

The invention claimed is:

1. A tilting converter comprising:

a container defining a first axis X and having a loading mouth;

a single support ring, coaxial to the container and spaced from said container, provided with two diametrically opposed supporting pins, defining a second axis Y orthogonal to the first axis X, adapted to allow a rotation of the converter about said second axis;

suspension elements, connecting said container to said support ring, restrained at a first end to the container and at a second end to the support ring;

wherein said suspension elements are a plurality of elastic bars clamped at said first end and at said second end;

and wherein said plurality of elastic bars comprises:

three groups of first elastic bars arranged parallel to the first axis X, said groups of first bars being arranged substantially equally spaced apart from each other along said support ring;

at least two pairs of second elastic bars, each pair of said second bars being arranged on a respective plane parallel to a first plane Y-Z orthogonal to the first axis X, where Z is an axis orthogonal to a second plane X-Y and passing through the intersection point between first axis X and second axis Y;

wherein each pair of second bars is symmetrically arranged with respect to a third plane X-Z;

wherein the second elastic bars of each pair are arranged with the respective longitudinal axes converging to each other, and wherein, in a position of the converter with the loading mouth facing upwards, at least one first pair of second elastic bars is arranged above the first plane Y-Z and the support ring, and at least one second pair of second elastic bars is arranged underneath the first plane Y-Z and the support ring.

2. A converter according to claim 1, wherein said elastic bars have equal dimensions.

3. A converter according to claim 1, wherein said three groups of first bars (7) are three pairs of first bars and there are provided only two pairs of second bars, one first pair of second bars being arranged at a first side of the first plane Y-Z and one second pair of second bars being arranged at a second side of the first plane Y-Z.

4. A converter according to claim 1, wherein said three groups of first bars are three pairs of first bars and there are provided three pairs of second bars, a first pair of second bars being arranged at a first side of the first plane Y-Z and two second pairs of second bars being arranged at a second side of the first plane Y-Z.

5. A converter according to claim 1, wherein said three groups of first bars are groups of three first bars and there are provided four pairs of second bars, a first pair of second bars being arranged at a first side of the first plane Y-Z and three second pairs of second bars being arranged at a second side of the first plane Y-Z.

6. A converter according to claim 1, wherein said three groups of first bars are groups of four first bars and there are provided six pairs of second bars, two first pairs of second bars being arranged at a first side of the first plane Y-Z and four second pairs of second bars being arranged at a second side of the first plane Y-Z.

7. A converter according to claim 1, wherein said three groups of first bars are groups of five first bars and there are provided seven pairs of second bars, three first pairs of second, bars being arranged at a first side of the first plane Y-Z and four second pairs of second bars being arranged at a second side of the first plane Y-Z.

8. A converter according to claim 1, wherein there is provided at least one third elastic bar, arranged so as to be diametrically opposite to a first group of first bars, arranged in proximity of the third plane X-Z, and arranged equally spaced apart from the second bars provided at both the sides of the third plane X-Z.

9. A converter according to claim 8, wherein said at least one third bar is provided underneath the support ring when the converter is in the vertical position, at said second side of the first plane Y-Z.

10. A converter according to claim 8, wherein said at least one third bar has dimensions which are equal to or different from the first bars and the second bars.

11. A converter according to claim 1, wherein the angle, which the longitudinal axis of each second bar of each pair forms with the third plane X-Z, is about 0÷40°, preferably equal to about 10÷30°.

12. A converter according to claim 1, wherein an end of said second bars is arranged in proximity of the supporting pins.

13. A converter according to claim 1, wherein the pairs of second bars are restrained at a first end to the container and at the other end to the support ring by means of locking on respective fixing brackets, and wherein the groups of first bars are restrained at a first end to the container by means of locking on a respective fixing bracket, and at a second end by means of locking directly on a first surface of the support ring, facing the loading mouth of the converter.

14. A converter according to claim 13, wherein the fixing brackets of the first bars are anchored to both a truncated cone area of the container and to the bottom of the container delimiting said truncated cone area.

* * * * *